US006784384B2

(12) United States Patent
Park et al.

(10) Patent No.: US 6,784,384 B2
(45) Date of Patent: Aug. 31, 2004

(54) ROTATION KEY DEVICE FOR A PORTABLE TERMINAL

(75) Inventors: Sung-Sun Park, Gumi-si (KR); Yong-Woo Jeon, Kumi-shi (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/724,898

(22) Filed: Dec. 2, 2003

(65) Prior Publication Data

US 2004/0118670 A1 Jun. 24, 2004

Related U.S. Application Data

(63) Continuation-in-part of application No. 10/356,552, filed on Feb. 3, 2003, now Pat. No. 6,670,563.

(30) Foreign Application Priority Data

Dec. 3, 2002 (KR) ..... 2002-76194
Jul. 1, 2003 (KR) ..... 2003-44409

(51) Int. Cl.[7] ..... H01H 9/30
(52) U.S. Cl. ..... 200/11 R; 200/4; 345/172
(58) Field of Search ..... 200/11 R, 11 A, 200/11 G, 13, 14, 4, 5 R, 7; 345/172, 161

(56) References Cited

U.S. PATENT DOCUMENTS 4,392,030 A * 7/1983 Buss ..... 200/11 R
4,493,954 A * 1/1985 Kimmel et al. ..... 200/11 R
5,430,262 A * 7/1995 Matsui et al. ..... 200/5 A
6,049,044 A * 4/2000 Mizobuchi ..... 200/4
6,236,002 B1 * 5/2001 Chou ..... 200/4

* cited by examiner

*Primary Examiner*—Kyung Lee
(74) *Attorney, Agent, or Firm*—Roylance, Abrams, Berdo & Goodman, L.L.P.

(57) ABSTRACT

A rotation key device for a portable terminal which includes a rotation key configured to rotate in forward and reverse directions. The rotation key device comprises a base plate, which is attached, at a lower surface thereof, to an upper surface of a first printed circuit board (PCB) mounted in a body of the portable terminal. A second PCB is attached to the upper surface of the base plate and is provided with a plurality of contact surfaces. A ring-shaped washer is attached to the upper surface of the second PCB, a rotation key is attached to the upper surface of the ring-shaped washer so that it can rotate in forward and reverse directions by a force applied thereto, a contact plate is provided in the rotation key, with a plurality of contact terminals, and a fixed button is coupled with the center of the rotation key so that the rotation key is rotatable.

35 Claims, 36 Drawing Sheets

ROTATION KEY DEVICE FOR A PORTABLE TERMINAL

This application is a continuation-in-part of prior application No. 10/356,552, filed Feb. 3, 2003 now U.S. Pat. No. 6,670,563.

PRIORITY

This application claims priority under 35 U.S.C. § 119 to an application entitled "Rotation Key Device For a Portable Terminal" filed in the Korean Intellectual Property Office on Dec. 3, 2002 and assigned Serial No. 2002-76194 and to an application entitled "Rotation Key Device For a Portable Terminal" filed in the Korean Intellectual Property Office on Jul. 1, 2003 and assigned Serial No. 2003-44409, the contents of both of which are incorporated herein by reference.

BACKGROUND OF THE INVENTION

1. Field of the Invention

The present invention relates to a rotation key device for a portable terminal, and more particularly, to a rotation key device for a portable terminal which includes a rotation key configured to rotate in forward and reverse directions, thereby being capable of rapidly achieving selection and confirmation of a desired operating mode function.

2. Description of the Related Art

Generally, bar-type wireless terminals are configured to have a bar-shaped single housing. Flip-type wireless terminals are configured such that a flip or cover is rotatably mounted to a bar-shaped housing by means of a hinge device, and folder-type wireless terminals are configured such that a folder is rotatably mounted to a bar-shaped housing by means of a hinge device so that it is foldable. Such conventional portable terminals are often equipped with an antenna unit, a data input/output unit, and a data transmitting/receiving unit. As is well known, a key pad is commonly used as the data input/output unit which is configured to input data when the keys provided thereon are pressed by a user's finger. A touch pad or touch screen is also often used. In order to perform the function of displaying data generated in accordance with an operation of the data input/output unit, a liquid crystal display (LCD) is commonly used. The keypad used to input data has an arrangement of a plurality of keys which includes a conversation start button (i.e., a send (SND) key), a cancel key, a correction or clear (CLR) key, numeral keys, character keys, an end (END) key, function keys, a power (PWR) key, among others. Typically, 15 or 20 of such keys are arranged at desired positions on the upper surface of the housing of a portable terminal, respectively, so that they are outwardly exposed. As the user presses a selected one of the exposed keys, desired data is input.

The construction of a conventional portable terminal equipped with such keys will be described with reference to FIGS. 1 and 2. As shown in FIGS. 1 and 2, the conventional portable terminal, which is of a folder type, includes two parts: a body 1 and a folder 2. The body 1 carries a key button 1*a*, four-direction adjusting keys 1*b* and a microphone 1*c*, whereas the folder 2 carries an LCD 2*a*, and a speaker 2*b*. A hinge unit 3 is rotatably mounted between the body 1 and the folder 2. An antenna 4 is provided at the upper end of the body 10. The portable terminal also includes a switch unit which comprises a plurality of dome switches 6 in order to create pleasant tactile feeling when touched. As shown in FIG. 2, the dome switches 6 are provided at a printed circuit board (PCB) 5 mounted in the body 1. When a selected one of the dome switches 6 comes into contact with a corresponding contact Sa on the PCB 5 in accordance with a key pressing manipulation by the user, an associated signal is generated. The dome switch 6 is configured to sense the contact signal generated in response to the pressing manipulation by the user.

Of the respective dome switches 6 having such a configuration, there is a key button 1*a* and the 4-direction adjusting keys 1*d*, adapted to perform various functions.

Using the conventional key button 1*a* and 4-direction adjusting keys 1*d* equipped in the body of the conventional portable terminal, the user selects a desired sequence of keys in association with a desired operating mode function. However, this procedure is inconvenient to the user, because the key sequence required to select and then confirm the operating mode function is complex. It is therefore impossible to achieve a rapid function switching operation. Furthermore, it is impossible to achieve a rapid mobile Internet search using the functions of the key button 1*a* and 4-direction adjusting keys 1*d*.

SUMMARY OF THE INVENTION

An object of the present invention is to substantially solve at least the above problems and/or disadvantages and to provide at least the advantages described below. Accordingly, an object of the present invention is to provide a rotation key device for a portable terminal which includes a rotation key configured to rotate in forward and reverse directions, thereby being capable of rapidly selecting a desired sequence of keys in association with a desired operating mode function.

Another object of the invention is to provide a rotation key device for a portable terminal which includes a rotation key configured to rotate in forward and reverse directions, thereby being capable of rapidly achieving selection and confirmation of a desired operating mode function.

In accordance with an embodiment of the present invention, these objects are accomplished by providing in an apparatus for inputting data by use of keys in a portable terminal, a rotation key device comprising a base plate attached, at a lower surface thereof, to an upper surface of a first PCB mounted in a body of the portable terminal. A second PCB is attached, at a lower surface thereof, to the upper surface of the base plate, and the second PCB is provided with a plurality of first dome switches and a second dome switch at the lower and upper surfaces thereof, and with a plurality of contact surfaces along the circumference of the second dome switch, for receiving an electrical contact signal in either a fixed or rotated state of a contact terminal and thus sensing the rotated position of the contact terminal according to the rotation direction thereof A ring-shaped washer is attached to the upper surface of the second PCB. A rotation key is supported by an upper surface of the ring-shaped washer so that the rotation key is rotatable in forward and reverse directions by an external force applied thereto. A contact plate is provided in the rotation key to rotate along with the rotation key. A plurality of contact terminals is also provided wherein each is adapted to come into contact with one of the contact surfaces of the second PCB and to generate an electrical signal from a rotation contact and a fixed contact of the rotation key, and apply the electrical contact signal to each of the contact surfaces coming into contact therewith. A fixed button is coupled centrally with the rotation key so that the rotation key is rotatable.

In accordance with another embodiment of the present invention, these objects are accomplished by providing in an apparatus for inputting data by use of keys in a portable terminal, a rotation key device comprising a base plate attached, at a lower surface thereof, to an upper surface of a first PCB mounted in a body of the portable terminal, the base plate being substantially centrally provided at an upper surface thereof with a plurality of coupling protrusions. A second PCB is attached, at a lower surface thereof, to the upper surface of the base plate while allowing the coupling protrusions to extend therethrough. The rotation key device is further provided at the lower surface thereof with a plurality of dome switches, and at an upper surface thereof with a plurality of contact surfaces for receiving an electrical contact signal at either a rotated position or a fixed position of a contact terminal and sensing the rotated position of the contact terminal according to the rotation direction of the contact terminal. A ring-shaped washer is attached to the upper surface of the second PCB. A rotation key is supported by an upper surface of the ring-shaped washer so that the rotation key is rotatable in forward and reverse directions by an external force applied thereto. A contact plate is coupled to an upper surface of the rotation key to rotate along with the rotation key. A plurality of contact terminals is further provided and wherein each is adapted to come into contact with one of the contact surfaces of the second PCB and to generate an electrical contact signal at a rotation contact or a fixed contact of the rotation key. A fixed button is coupled with a center portion of the upper surface of the second PCB.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENTS

Figure 1:
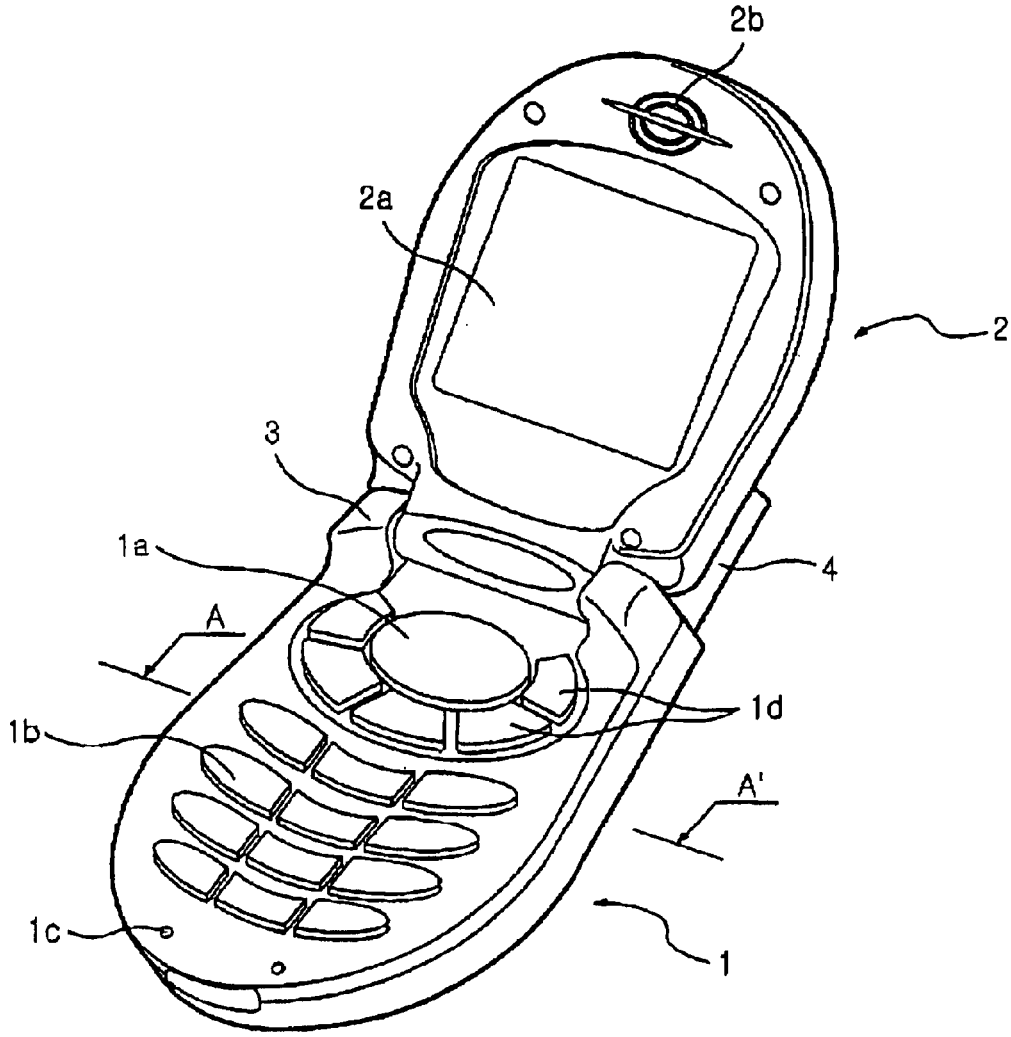
FIG. 1 (PRIOR ART)
FIG. 1 is a perspective view illustrating a conventional folder type terminal in a state in which its folder is opened.
Figure 2:
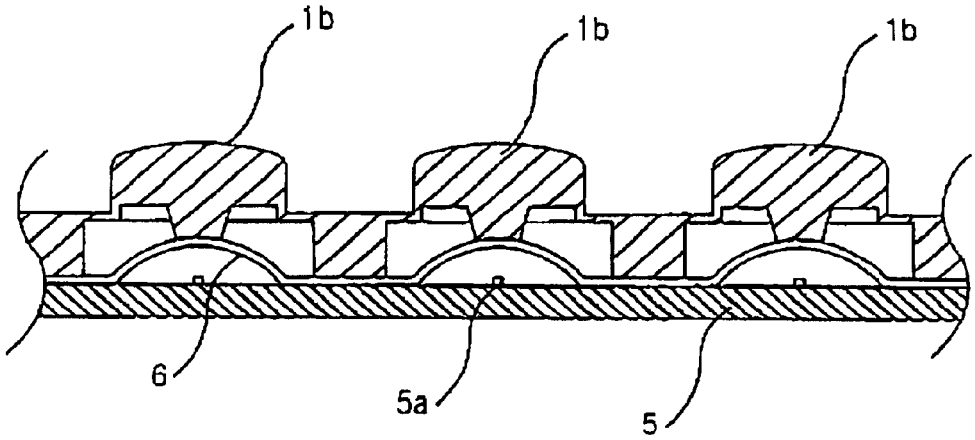
FIG.2 (PRIOR ART)
FIG. 2 is a cross-sectional view taken along the line A–A' of FIG. 1.

Several preferred embodiments of the present invention will now be described in detail with reference to the annexed drawings. In the drawings, the same or similar elements are denoted by the same reference numerals even though they are depicted in different drawings. In the following description, a detailed description of known functions and configurations incorporated herein have been omitted for conciseness.

Figure 3:
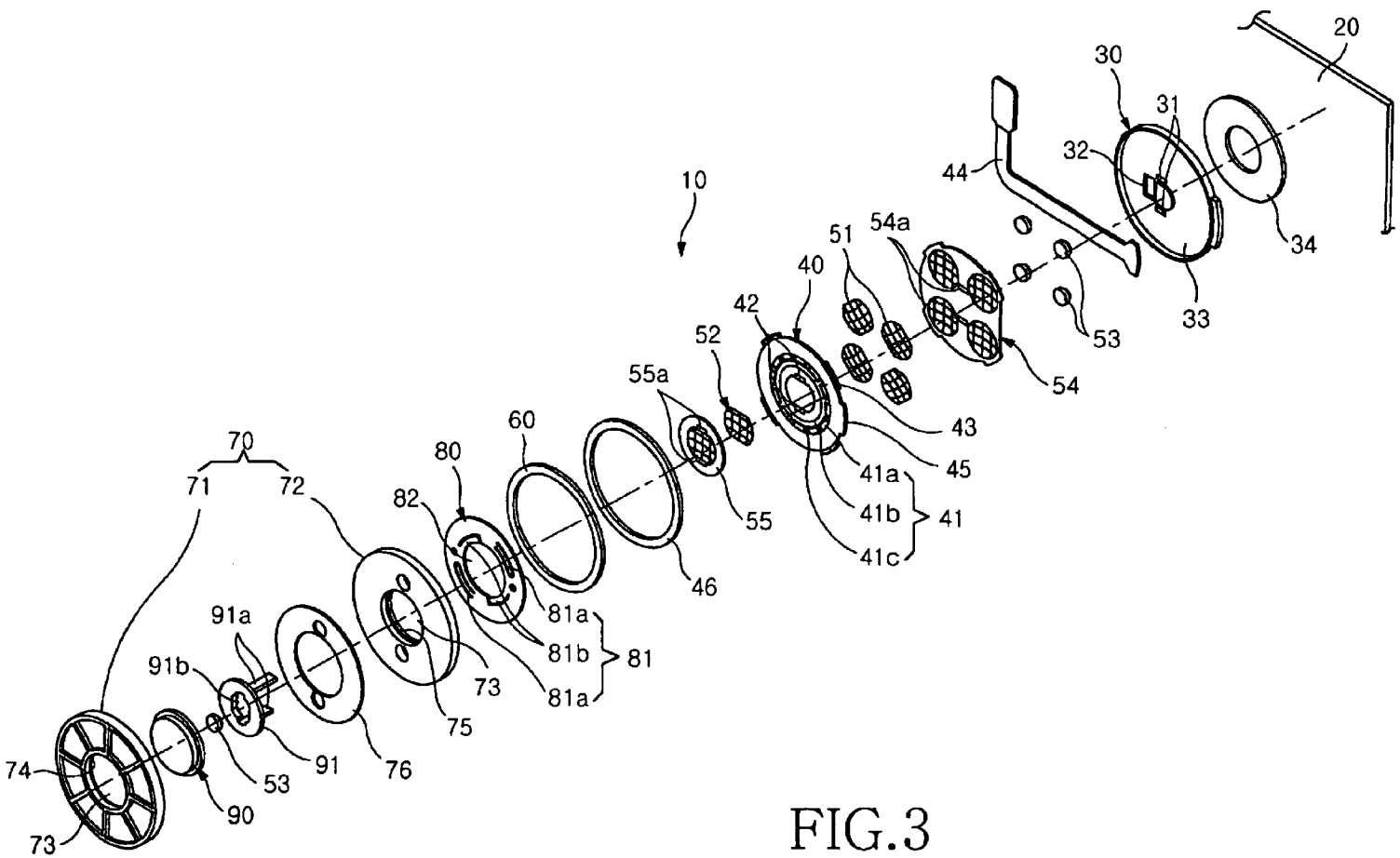
FIG. 3 is an exploded perspective view illustrating a rotation key device for a portable terminal in accordance with an embodiment of the present invention.
Figure 4:
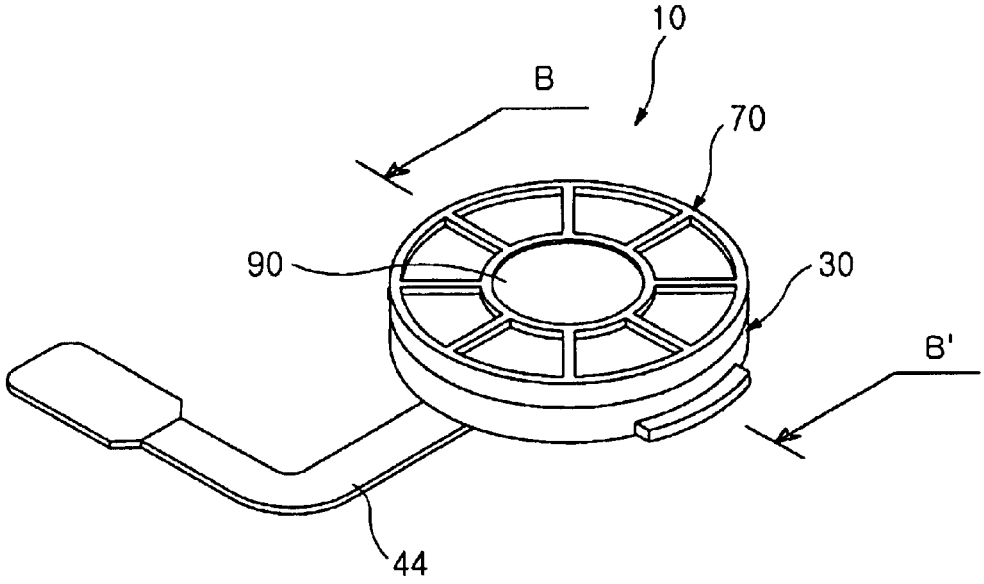
FIG. 4 is a perspective view illustrating an assembled state of the rotation key device according to the embodiment of the present invention.
Figure 5:
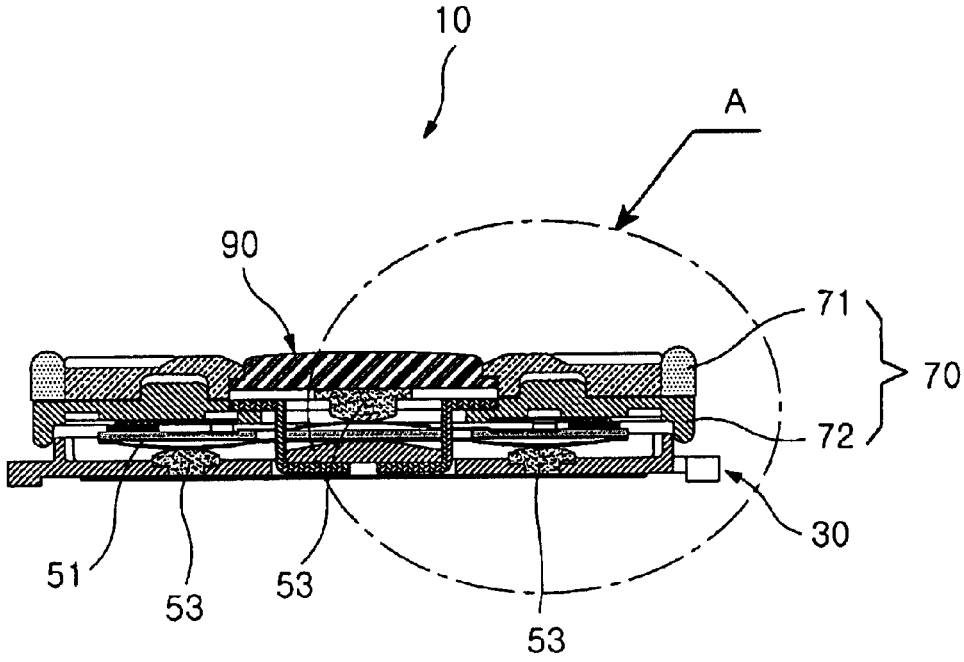
FIG. 5 is a cross-sectional view taken along the line B—B of FIG. 4.

Referring to the annexed drawings, in particular, FIG. 3, a rotation key device according to a preferred embodiment of the present invention is illustrated. This rotation key device is applied to a portable terminal which includes a terminal body 1. The rotation key device includes a body 10. The body 10 includes a base plate 30, a second PCB 40, a rotation key 70, a contact plate 80, and a fixed button 90, which are coupled to one another. A first bonding member 34 is attached to one surface of the base plate 30 so that the base plate 30 is bonded to an upper surface of the first PCB 20. A plurality of first dome switches 51 (four dome switches in the illustrated case) are provided at one surface of the second PCB 40, and one second dome switch 52 at a center portion of the other surface of the second PCB 40. A first switch bonding member 54 is provided at one surface of the second PCB 40 to bond the first dome switches 51 to the second PCB 40, whereas a second switch bonding member 55 is provided at the surface of the second PCB 40 to bond the second dome switch 52 to the second PCB 40. Coupling hole pairs 54*a* and 55*a* are formed in the center portions of the first and second switch bonding members 54 and 55 to allow a pair of coupling protrusions 91*a* formed at the fixed button 90 to extend therethrough.

The second PCB 40 is formed with a plurality of contact surfaces 41 at the other surface, each adapted to receive an electrical signal in either a fixed state or rotated state of the contact plate 80 and thus to sense the rotated position of the contact plate 80 according to its rotation direction.

A ring-shaped washer 60 is attached to the upper surface of the second PCB 40 by means of a second bonding member 46, in order to allow the rotation key 70 to be rotatable. The rotation key 70 is laid on the upper surface of the ring-shaped washer 60 so that it is rotatable in forward and reverse directions by an external force applied thereto. The contact plate 80 is formed with a plurality of contact terminals 81 to contact the contact surfaces 41 of the second PCB 40 as the contact plate 80 rotates along with the rotation key 700. The contact plate 80 is laid on the upper surface of the rotation key 70 to generate electrical signals from rotational contacts and fixed contacts of the rotation key 70.

The fixed button 90 is provided rotatably at the center of the rotation key 70 such that the fixed button 90 extends through the second PCB 40, the ring-shaped washer 60 and the contact plate 80 in this order when it is coupled to the rotation key 70. Under the fixed button 90 is provided a fixing member 91 adapted to extend through a pair of coupling holes 31 formed at the base plate 30, the coupling hole pairs 54*a* and 55*a*, and a pair of coupling holes 42 of the second PCB 40. The base plate 30 has a circular disc structure while being centrally provided with the coupling holes 31 to receive fixing protrusions 91*a* of the fixing member 91. A through hole 32 is formed at the base plate 30 in the vicinity of the coupling holes 31, in order to receive an flexible printed circuit board (FPCB) 44 therethrough. An insertion hole 33 is formed in the base plate 30 to allow the second PCB 40 to extend therethrough.

The dome switches 51 and 52 are provided with a plurality of support members 53 to facilitate the operation of the dome switches 51 and 52 in contact with the support members 53. The pair of coupling holes 42 are formed centrally in the second PCB 40, adapted to allow the fixing protrusions 91*a* of the fixing member 91 to extend therethrough. A plurality of light emitting diodes (LEDs) 43 are arranged along the circumference of the second PCB 40. The LEDs 43 emit light in response to electrical contact signals from the contact terminals 81. The FPCB 44 is disposed at a predetermined position of the second PCB 40, for delivering the contact signal of the second PCB 40 to the body 1. The second PCB 40 is provided, at a desired position on its circumference, with a contact portion 43 adapted to come into contact with the FPCB 44 so that electrical contact signals applied to the second PCB 40 can be sent to the interior of the body 100 via the FPCB 44. The contact surfaces 41 of the second PCB 40 includes a plurality of first contact surfaces 41*a* circumferentially arranged while being substantially uniformly spaced apart from one another on the upper surface of the second PCB 40. When each first contact surface 41*a* comes into contact with any one of first contact terminals 81*a* of the contact plate 80, it receives an electrical contact signal from the contact terminal. The contact surfaces 41 of the second PCB 40 further comprise a plurality of second contact surfaces 41*b* inside the first contact surfaces 41*a* Also, the contact surfaces 41 of the second PCB 40 further comprise a plurality of inserted contact surfaces 41*c*, each formed at the upper surface of the second PCB 40 between adjacent ones of the first contact surfaces 41*a*. When the first contact terminal 81*a* enters any of the second contact surfaces 41*b* during rotating, the second contact surface 41*b* receives an electrical contact signal from the first contact terminal 81*a*. Each of the contact surfaces 41*a* and 41*c* are elongated or shortened to control the sensing speed of the first contact terminal 81*a* along with the rotation of the rotation key 70.

The contact terminals 80 comprises a pair of first contact terminals 81*a* adapted to generate an electrical contact signal in contact with any of the first contact surfaces 41*a* and the inserted contact surfaces 41*c*, and a pair of second contact terminals 81*b* in the vicinity of the first contact terminals 81*a*, adapted to support the rotation of the first contact terminals 81*a*, in contact with the second contact surfaces 41*b*.

A through hole 82 is centrally formed at the contact plate 80 so as to allow the fixing protrusions 91 of the fixed button 90 to extend therethrough. The contact terminals 81*a* and 81*b* of the contact plate 80 are arranged to be substantially uniformly spaced apart from one another in a circumferential direction, facing each other. Each contact terminal is formed by cutting out a desired portion of the contact plate 80 to leave a portion corresponding to the contact terminal, and then bending the left portion to be protruded toward the rotation key 70. The contact terminals 81*a* and 81*b* are substantially symmetrically arranged such that they face each other and the facing ones of the contact terminals cross each other in the rotating direction of the rotation key. Each contact terminal 81*a* or 81*b* has, at its free end, a bent portion 81*c* adapted to allow the contact terminal 80 to rotate in reliable contact with one of the contact surfaces 41. The contact plate 80 is made of a stainless steel material so that it is electrically conductive.

The rotation key 70 comprises an upper case 71 and a lower case 72. Fitting holes 73 are formed centrally at the upper and lower cases 71 and 72 to allow the fixed button 90 to fit thereinto. The upper case 71 of the rotation key 70 is provided with a first step 74 formed at the center in order to couple the rotation key 70 rotatably with the fixed button 90. A second step 75 is formed at the center of the lower case 72 couple the rotation key 70 rotatably with the fixed button 90. A case bonding member 76 is provided between the upper and lower cases 71 and 72 to bond them to each other. The fixing member 91 is provided with the fixing protrusions 91*a* to extend through the coupling holes 42 of the second PCB 40, the coupling holes 31 of the base plate 30 and the coupling holes 54*a* and 55*a* of the switch bonding members 54 and 55. A through hole 91*b* is formed at the center of the fixing member 91 to allow the support members 53 to extend therethrough from the rear direction and contact the second dome switch 52. The fixing protrusions 91*a* have, at their free ends, portions 91*c* to engage with the rear surface of the base plate 30.

A process for assembling and operating the rotation key device having the configuration according to the embodiment of the present invention as described above will now be described in detail with reference to FIGS. 3 to 17.

As shown in FIGS. 3 to 6, the first PCB 20 is first mounted in the body 10 of the portable terminal. Thereafter, the base plate 34 is attached, at its one surface, to the upper surface of the first PCB 20 by means of the first bonding member 40. The first four dome switches 51 are attached to one surface of the second PCB 20 by means of the first switch bonding member 54, while the second single dome switch 52 is attached to the center of the other surface of the second PCB 40 by means of the second switch bonding member 55.

The ring-shaped washer 60 is then attached to the upper surface of the second PCB 40 by means of the second bonding member 46 such that it is arranged around the circumference of the second PCB 40.

Under this condition, the contact plate 80 having the first and second contact terminal pairs 81*a* and 81*b* thereon is coupled to the upper surface of the rotation key 70. The fixed button 90 is coupled to the center of the rotation key 70 so that the rotation key 70 is rotatable. In this state, the fixed button 90 extends through the base plate 20, the second PCB 40, the ring-shaped washer 60, and the contact plate 80 in this order, coupling one another.

Since the fixing member 91 is under the fixed button 90 and has the fixing protrusions 91*a*, the fixing protrusions 91*a* extend through the coupling holes 31 of the base plate 20, the coupling holes 42 of the second PCB 40, and the coupling holes 54*a* and 55*a* of the switch bonding members 54 and 55.

As shown in FIGS. 5 to 8, extending through the coupling holes 31 of the base plate 30, the ends of fixing protrusions 91*a* are bent and fixedly coupled with the rear surface of the base plate 30.

Figure 6:
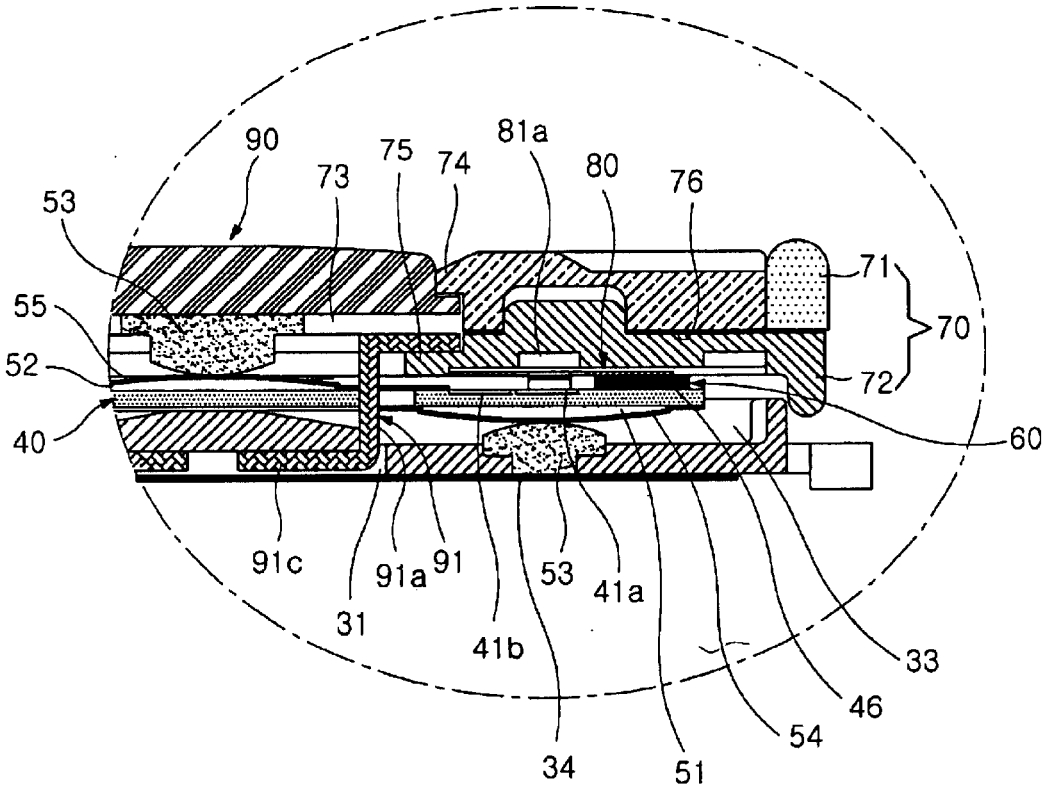
FIG. 6 is an enlarged sectional view of a portion "A" illustrated in FIG. 4.
Figure 7:
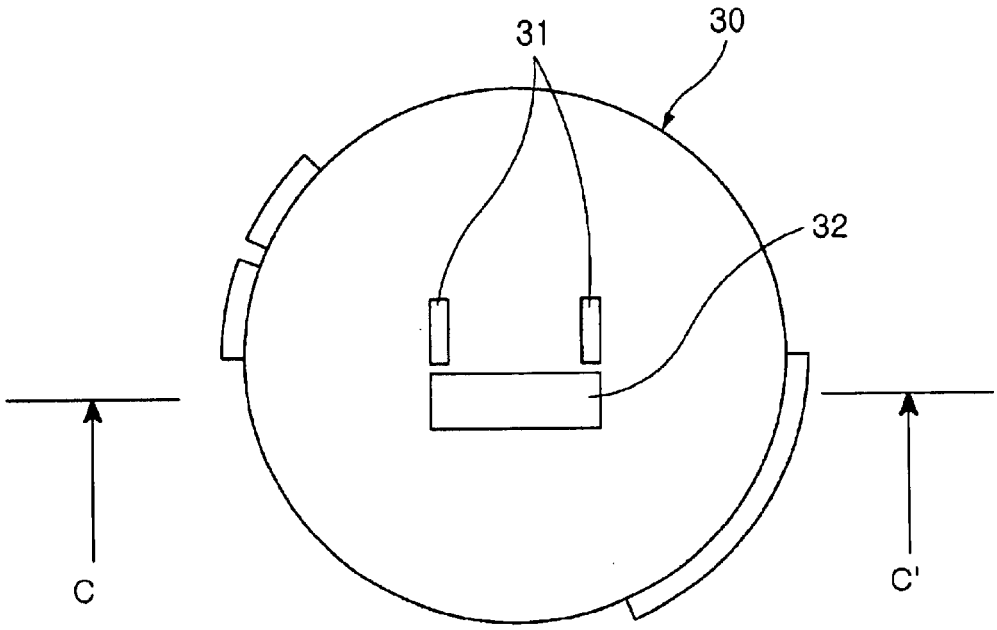
FIG. 7 is a bottom view illustrating a base plate included in the rotation key in accordance with the embodiment of the present invention.
Figure 8:
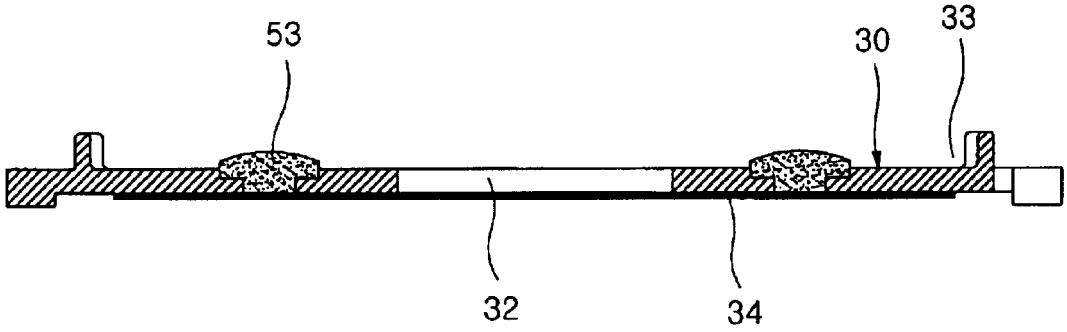
FIG. 8 is a cross-sectional view taken along the line C–C' of FIG. 7.

As shown in FIG. 6, the rotation key 70 comprises the upper and lower cases 71 and 72, and the fitting holes 73 are formed at the centers of the upper and lower cases to fit the fixed button 90 thereinto.

The first step 74 formed at the center of the upper case 71 couples the fixed button 90 to the rotation key 70 such that the rotation key 70 is rotatable in forward and reverse directions by an external force applied thereto. The second step 75 formed at the center of the lower case 72 also couples the fixing member 91 of the fixed button 90 to the rotation key 70 such that the rotation key 70 is rotatable in forward and reverse directions by an external force applied thereto.

Figure 9:
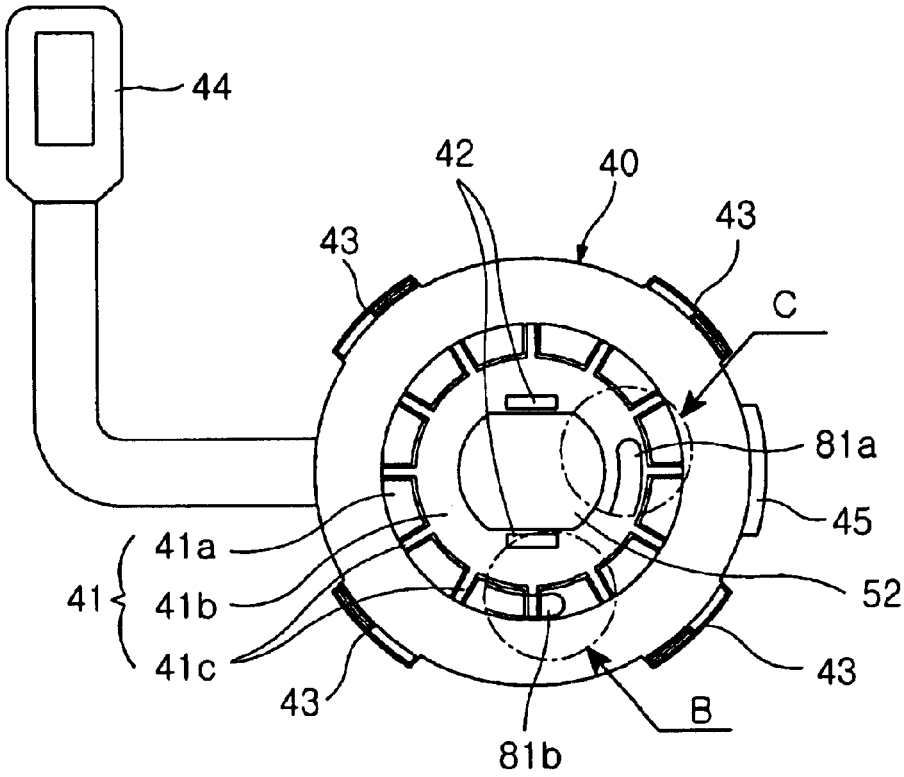
FIG. 9 is a plan view illustrating a second PCB included in the rotation key device in accordance with the embodiment of the present invention.

As shown in FIG. 9, the first and second contact terminal pairs 81*a* and 81*b* of the contact plate 80 are arranged to be substantially uniformly spaced apart from one another in a circumferential direction. Both the first and second contact terminal pairs 81*a* and 81*b* of the contact plate 80 are formed substantially symmetrically such the first contact pair 81*a* faces each other as does the second contact pair 81*b*. Both the first and second contact terminal pairs 81*a* and 81*b* cross each other in the rotating direction of the rotation key 70 and thus come into contact with the first and second contact surfaces 41*a* and 41*b* of the second PCB 40. Each contact terminal has, at its free end, a bent portion 81*c* adapted to allow the contact terminals to come into reliable contact with the contact surfaces 41*a* and 41*b*. Under this condition, when the rotation key 70 is rotated, the contact plate 80 also is rotated.

As shown in FIG. 9, the second PCB 40 is provided with the first and second contact surfaces 41*a* and 41*b* circumferentially arranged and substantially uniformly spaced apart from one another on the upper surface thereof. The first and second contact surfaces 41*a* and 41*b* can then receive electrical contact signals from the contact terminal 81*a* and 81*b* when contact plate 80 is in either a fixed or rotated state, thereby sensing a rotated position and direction of the rotation key 700.

Figure 11:
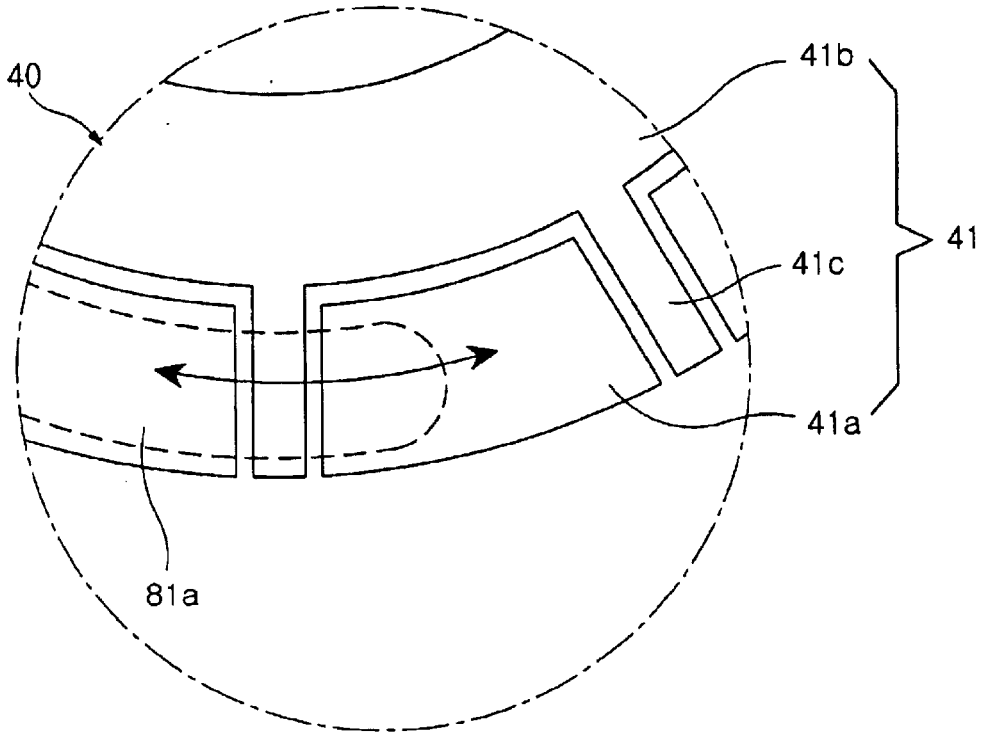
FIG. 11 is an enlarged sectional view corresponding to a portion "B" of FIG. 9, illustrating the state in which a first contact terminal enters between first contact surfaces.

As shown in FIG. 11, when any one of the first contact terminals 81*a* of the contact plate 80 enters between adjacent ones of the first contact surface 41*a*, an electrical contact signal is generated at the position of the first contact terminal 81*a*.

Figure 12:
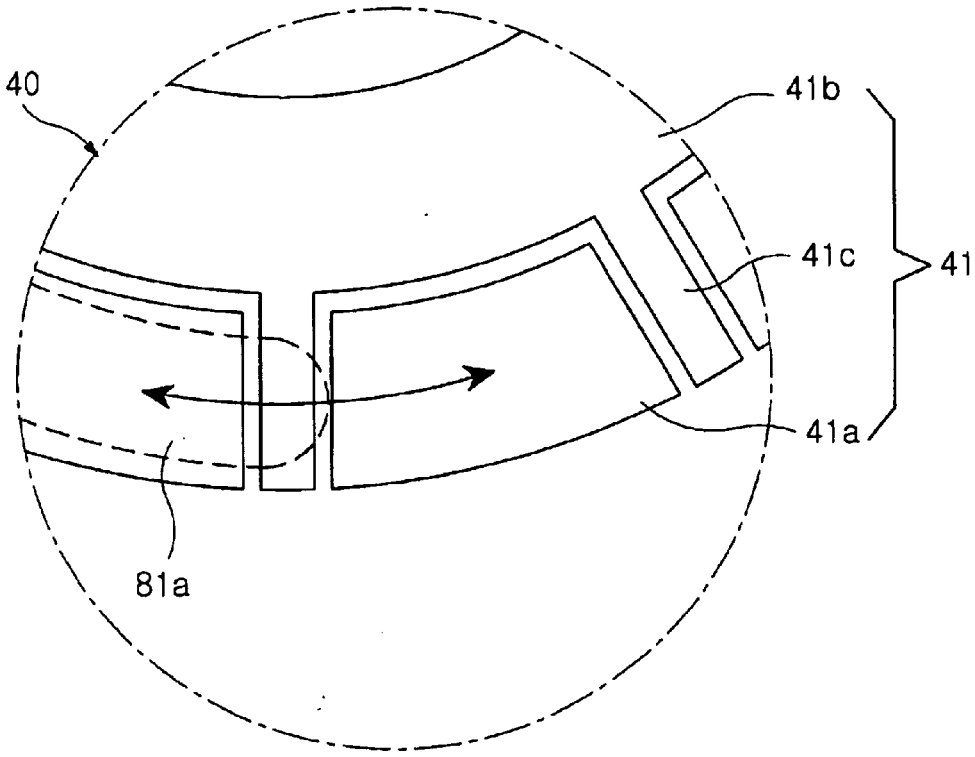
FIG. 12 is an enlarged sectional view corresponding to the portion "B" of FIG. 9, illustrating the state in which the first contact terminal enters between inserted contact surfaces.
Figure 13:
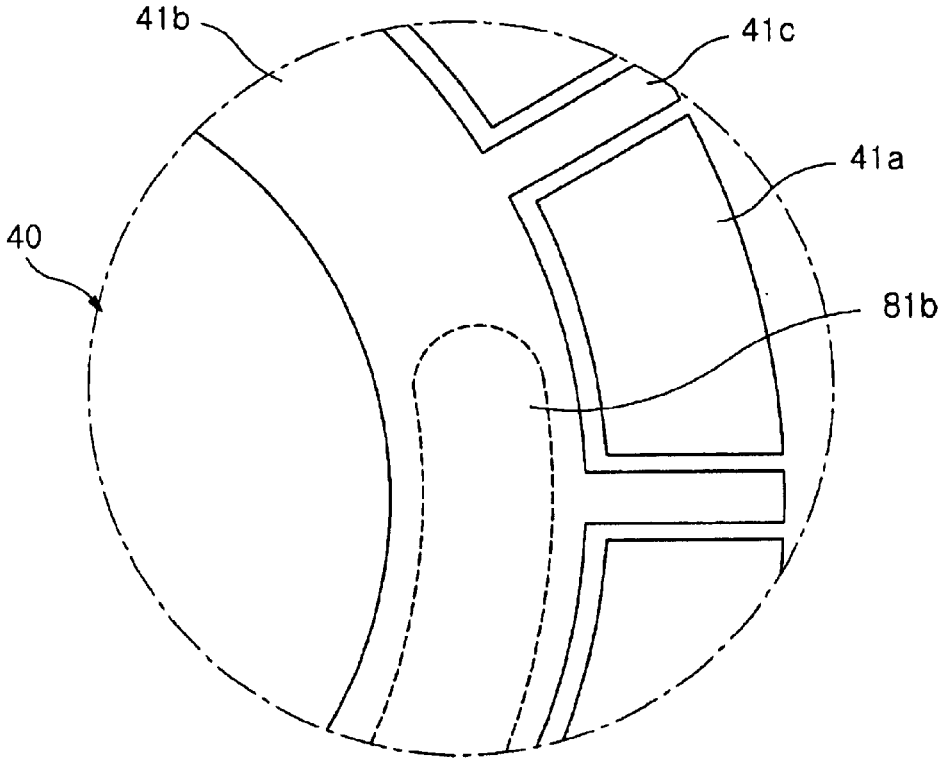
FIG. 13 is an enlarged sectional view corresponding to a portion "C" of FIG. 9, illustrating the state in which a second contact terminal contacts a second contact surface.
Figure 14:
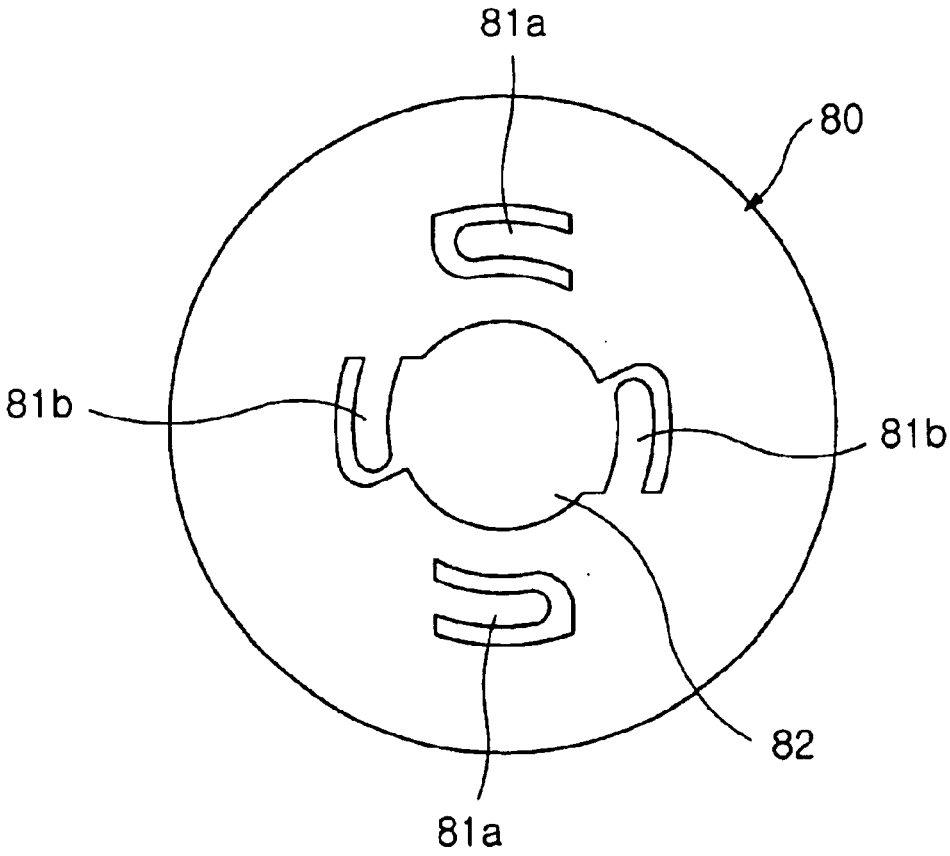
FIG. 14 is a plan view illustrating a contact plate included in the rotation key device in accordance with the embodiment of the present invention.
Figure 15:
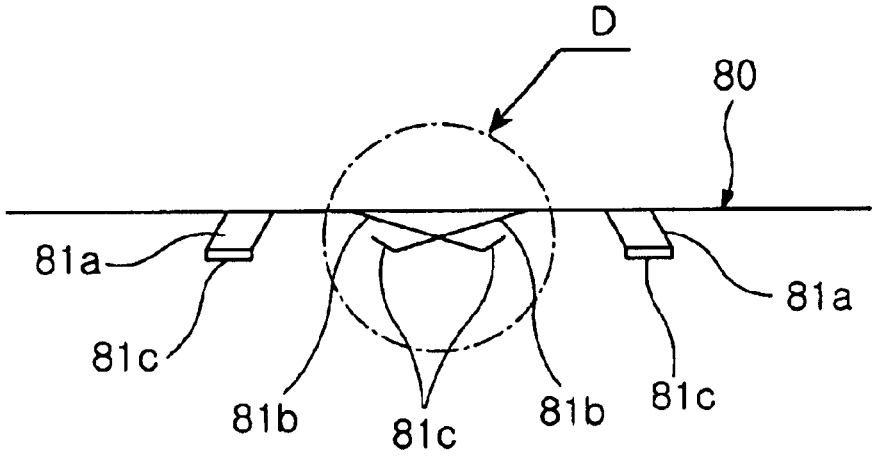
FIG. 15 is a side sectional view illustrating the contact plate included in the rotation key device in accordance with the embodiment of the present invention.
Figure 16:
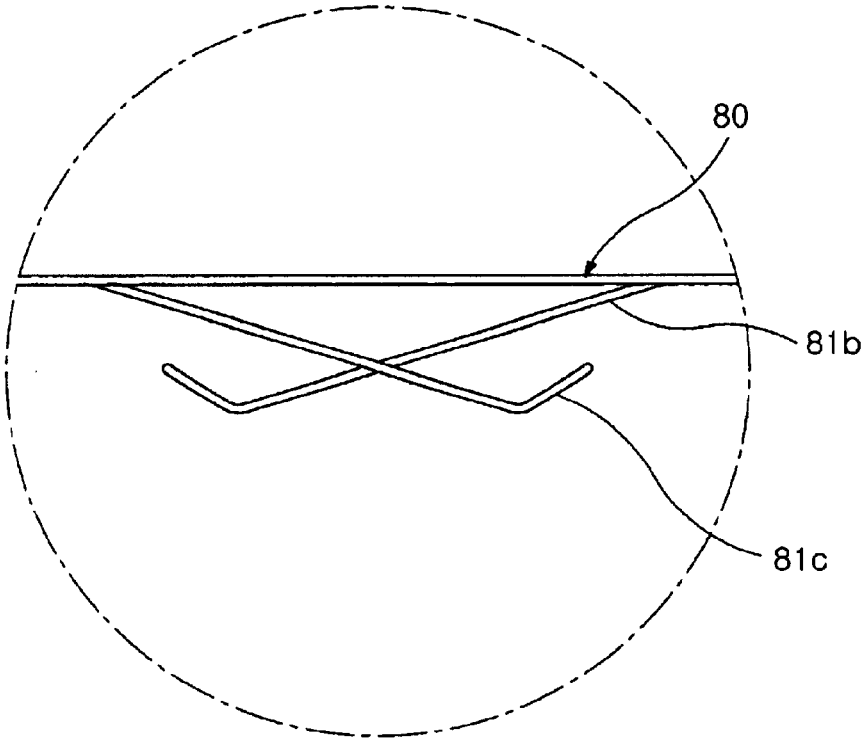
FIG. 16 is an enlarged sectional view of a portion "D" of FIG. 15.

As shown in FIG. 12, the second contact surfaces 41*b* are defined inside the first contact surfaces 41*a*. The inserted contact surfaces 41*c* are arranged along the circumference of the second contact surfaces 41*b*, so that the inserted contact surfaces 41*c* are between the first contact surfaces 41*a*. When any one of the first contact terminals 81*a* of the contact plate 80 enters between adjacent ones of the inserted contact surfaces 41*c*, an electrical contact signal is generated at the position of the first contact terminal 81*a*. The second contact terminals 81*b* support the first contact terminals 81*a*, while contacting the second contact surfaces 41*b*, so that the first contact terminals 81*a* can rotate.

A brief description will now be given of the sequence of electrical contact signals generated as each of the contact terminal 81*a* and 81*b* comes into contact with the first and second contact surfaces 41*a*, 41*b* and 41*c* in a sequential fashion in accordance with the rotation of the rotation key 70. It is assumed that the contact signals of the rotation key 70 correspond to "A", "B", "C", "D", and "E". When the rotation key 70 rotates in a forward, or clockwise (CW) direction, the contact signals from each of the contact terminals 81*a* and 81*b* are generated in a sequence of E-D-C-B-A-E . . . . Alternatively, when the rotation key 700 rotates in a reverse, or counter-clockwise (CCW) direction, the contact signals from the contact terminals are generated in a sequence of A-B-C-D-E-A . . . .

Figure 10:
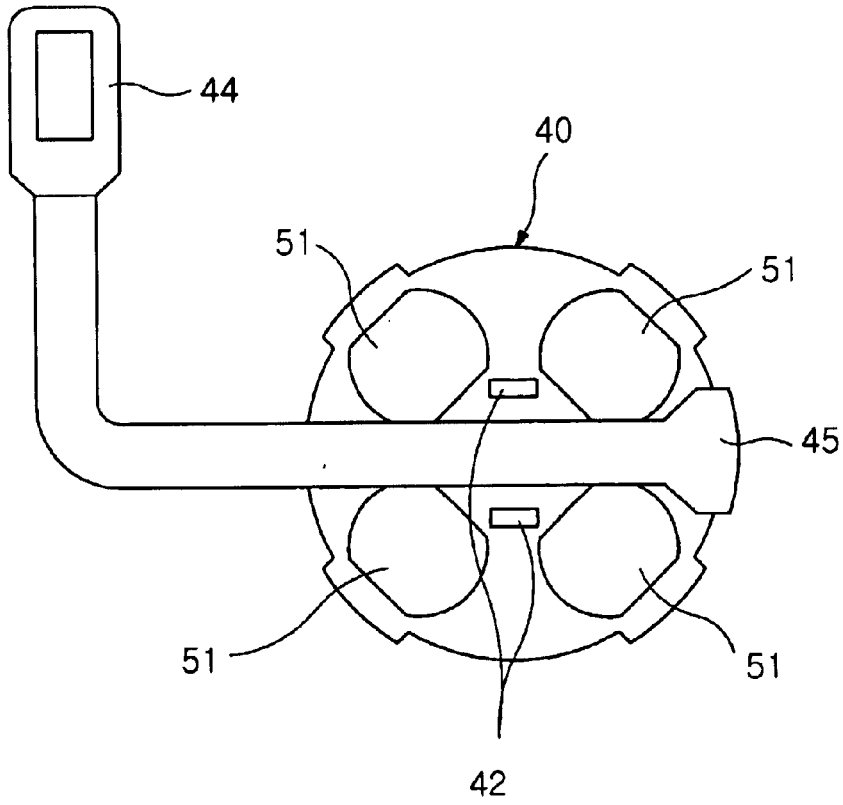
FIG. 10 is a bottom view illustrating the second PCB included in the rotation key device in accordance with the embodiment of the present invention.
Figure 17:
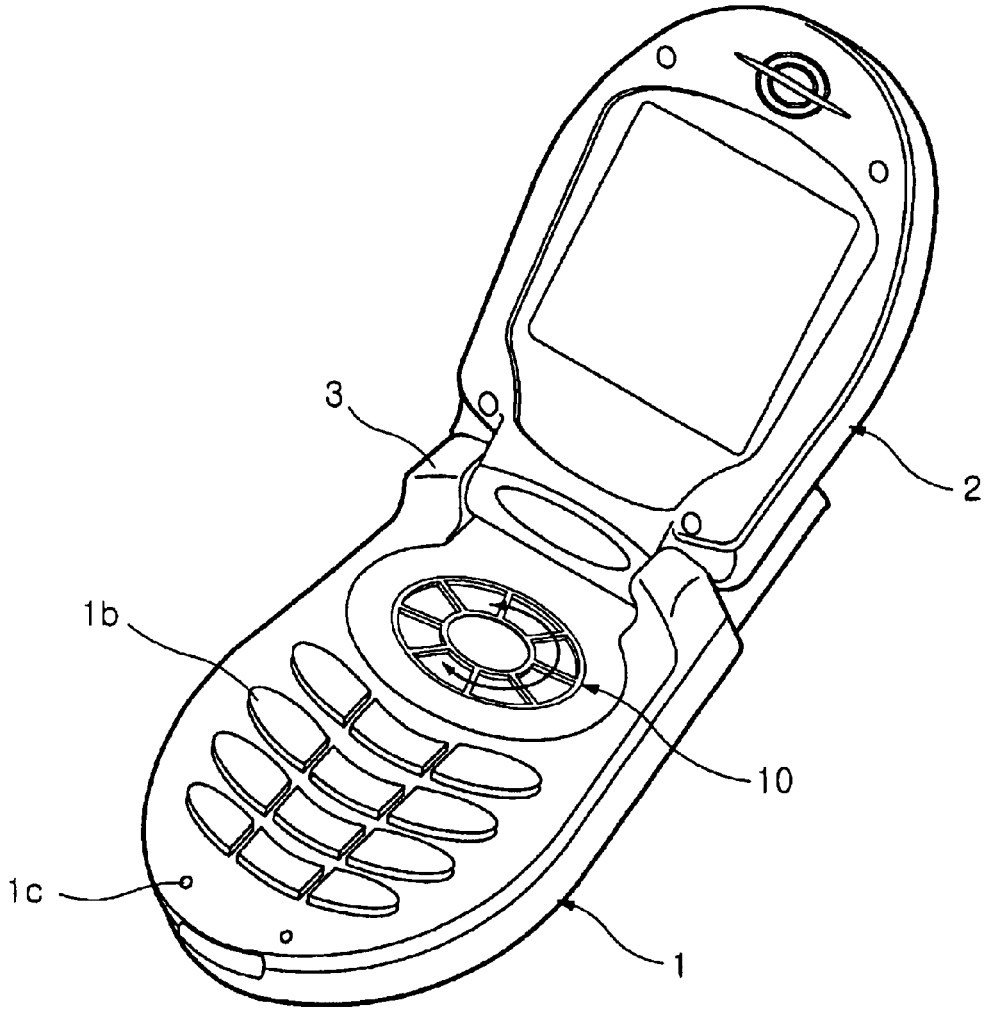
FIG. 17 is an perspective view illustrating the portable terminal, to which the rotation key device according to the embodiment of the present invention is applied, in a state in which its folder is opened.

As shown in FIGS. 10 and 17, the sequence of contact signals from the contact terminals 81*a* and 18*b* are sent to the body 10 of the portable terminal via the FPCB 44 contacting the contact portion 45 of the second PCB 40. When a user selects a desired operation mode function while rotating the rotation key 70, and presses an associated button, an associated one of the dome switches 51 and 52 comes into contact with an associated contact of the second PCB 40. As a result, an electrical signal is applied to the second PCB 40, and then sent to the body 10 of the portable terminal via the FPCB 44.

The fixed button 90 performs one of operation mode functions given to the portable terminal, e.g., a cancel key function. When the user presses the fixed button 90, the dome switch 52 comes into contact with an associated contact of the second PCB 40. As a result, an electrical signal is applied to the second PCB 40, and then sent to the body 10 of the portable terminal via the FPCB 44.

The LEDs 43 are arranged along the circumference of the second PCB 40. The LEDs 43 emit light in response to electrical contact signals from the contact terminals 81, in order to illuminate the sides of the rotation key 70.

The first contact terminals 81*a* can be configured to quickly ascertain the rotation of the rotation key 70 by elongating the first contact surfaces 41*a*, and to minimize recognition of the rotation of the rotation key 70 by shortening the first contact surfaces 41*a*. Likewise, the first contact terminals 81*a* can be configured to quickly ascertain the rotation of the rotation key 70 by shortening the inserted contact surfaces 41*c*. The rotation recognizing speed of the first contact terminals 81*a* can be controlled by adjusting the lengths of the contact surfaces 41*a* and 41*c*.

By configuring the contact surfaces 41*a* and 41*c* as described above, the user can freely set the speed of scrolling on the LCD 2*a*. Given five first contact surfaces 41*a* for the first contact terminals 81*a*, one rotation of the rotation key 70 leads to 5-line scrolling on the LCD 2*a* at a time.

The process of assembling and operation of a rotation key device according to another embodiment of the present invention will now be described in detail with reference to FIGS. 18 to 36.

As shown in FIGS. 18 to 21, the rotation key device is applied to a portable terminal which includes a terminal body 100 provided with a first PCB 200. A first bonding member 300 is attached to one surface (lower surface) of the base plate 400 so that the base plate 400 is bonded to the upper surface of the first PCB 200. A plurality of coupling protrusions 401 (shown in FIG. 19) are centrally provided at the other surface (upper surface) of the base plate 400 in order to couple a second PCB 500 to the upper surface of the base plate 400 by means of a second bonding member 301. A plurality of first coupling holes 503 are centrally formed on the second PCB 500 to engage with the coupling protrusions 401.

A plurality of dome switches 501 (five dome switches in the illustrated case) are provided at one surface (lower surface) of the second PCB 500. The second PCB 500 is formed with a plurality of contact surfaces 502 at the other surface (upper surface). With the coupling protrusions 401 of the base plate 400 extended through the first coupling holes 503, a ring-shaped washer 600 is attached to the upper surface of the second PCB 500 by means of a third bonding member 302. The ring-shaped washer 600 is peripherally provided over the second PCB 500.

Figure 20:
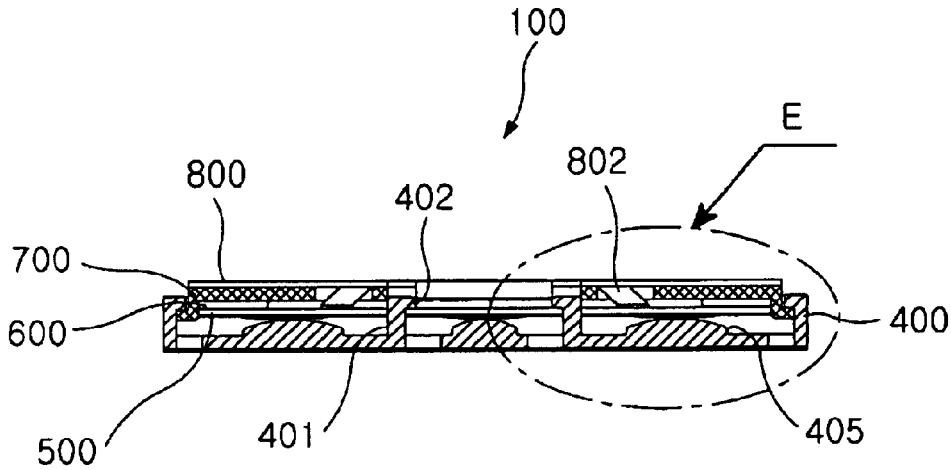
FIG. 20 is a cross-sectional view taken along the line D–D' of FIG. 19.
Figure 21:
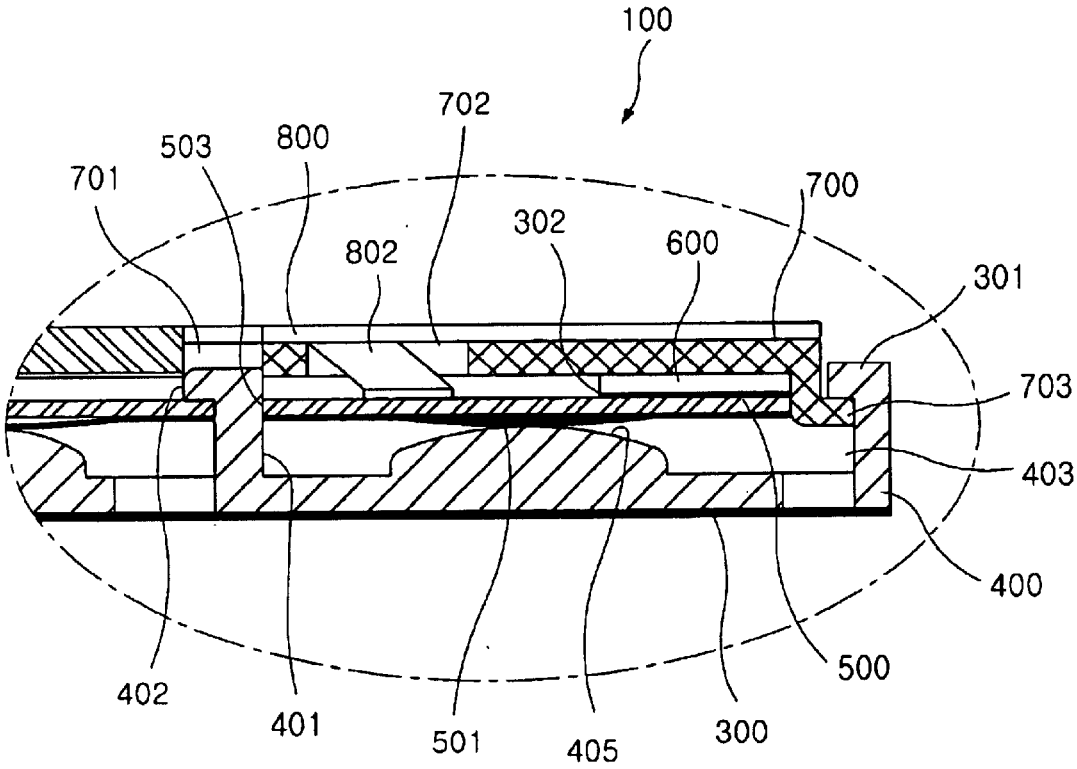
FIG. 21 is an enlarged sectional view of a portion "E" illustrated in FIG. 20.
Figure 22:
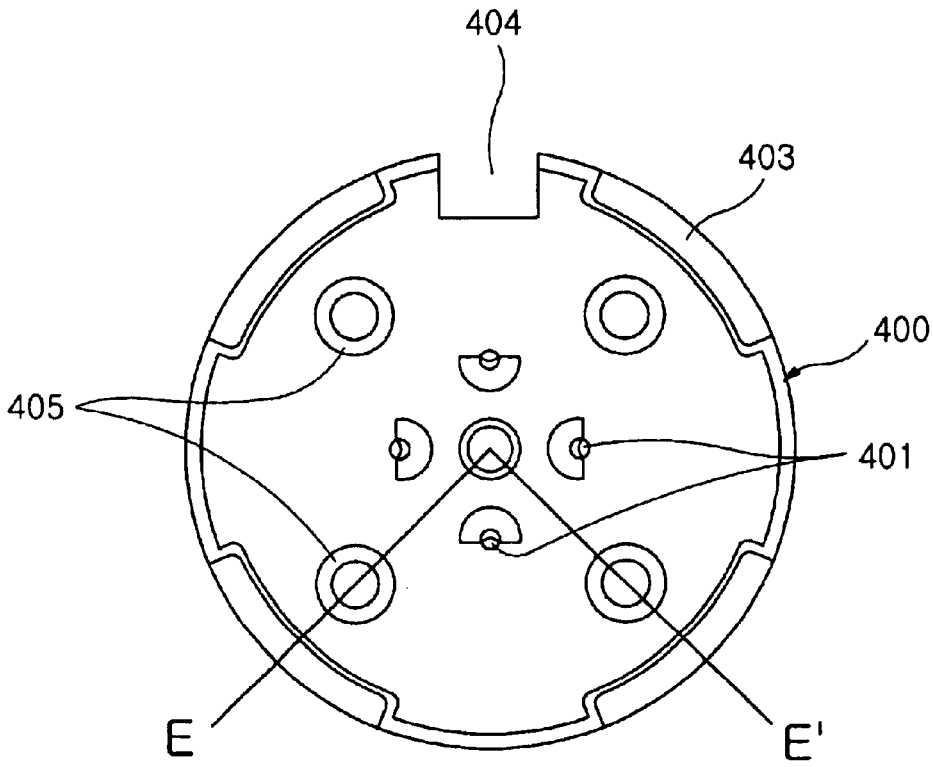
FIG. 22 is a plan view illustrating a base plate included in the rotation key in accordance with the second embodiment of the present invention.
Figure 23:
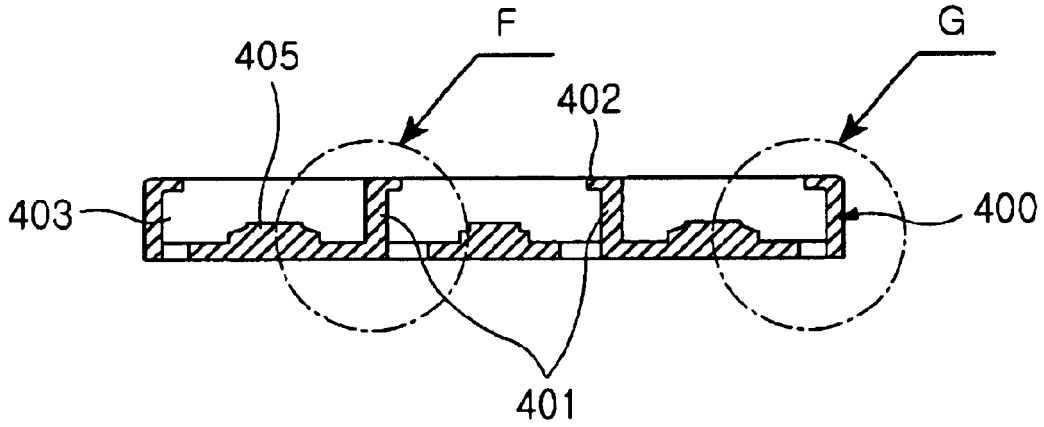
FIG. 23 is a cross-sectional view taken along the line E–E' of FIG. 22.
Figure 24:
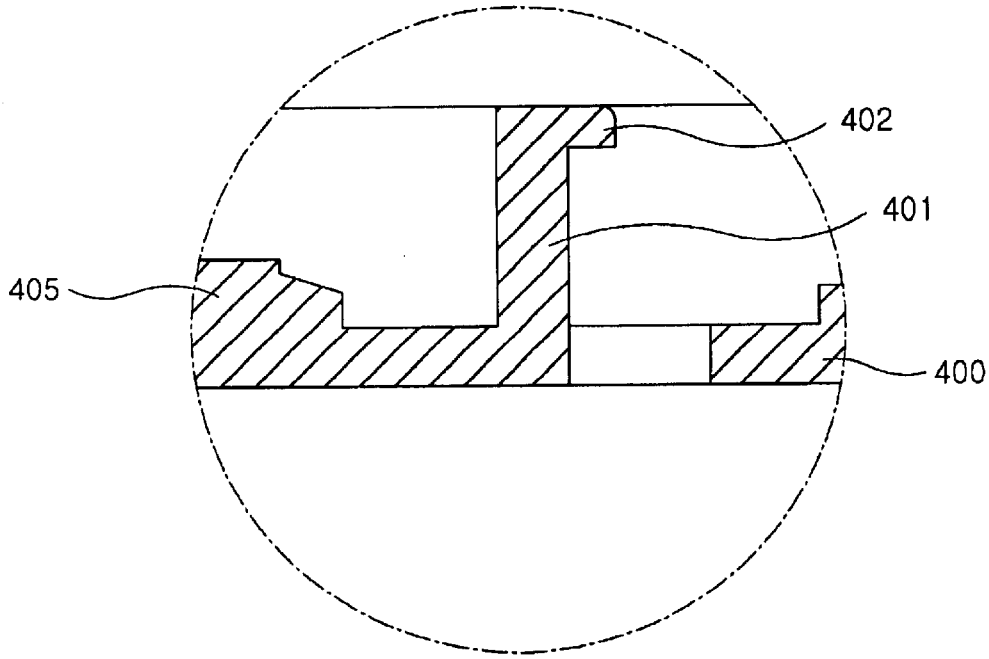
FIG. 24 is an enlarged sectional view of a portion "F" illustrated in FIG. 23.
Figure 25:
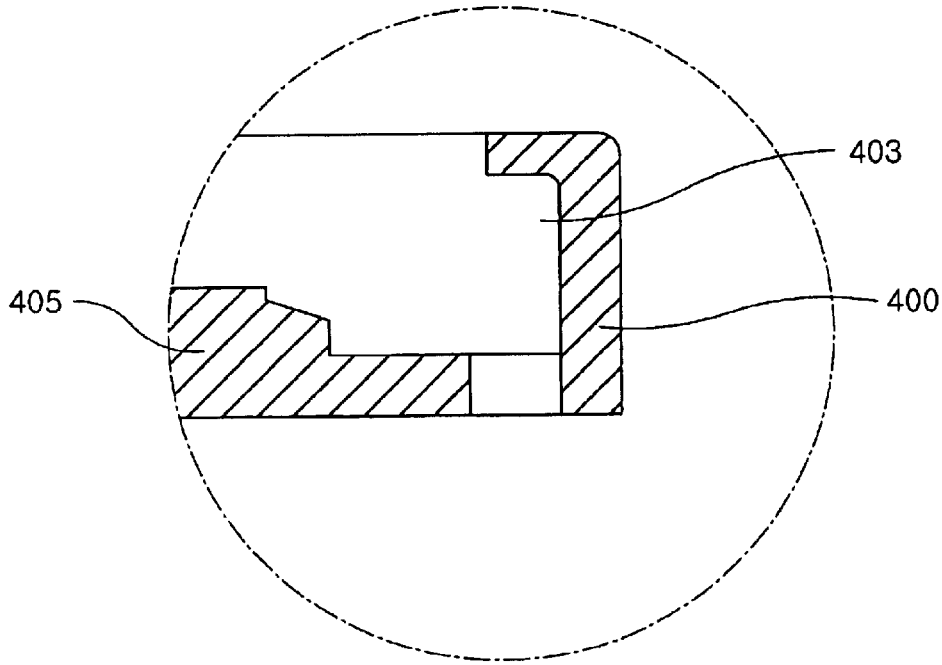
FIG. 25 is an enlarged sectional view of a portion "G" illustrated in FIG. 23.
Figure 26:
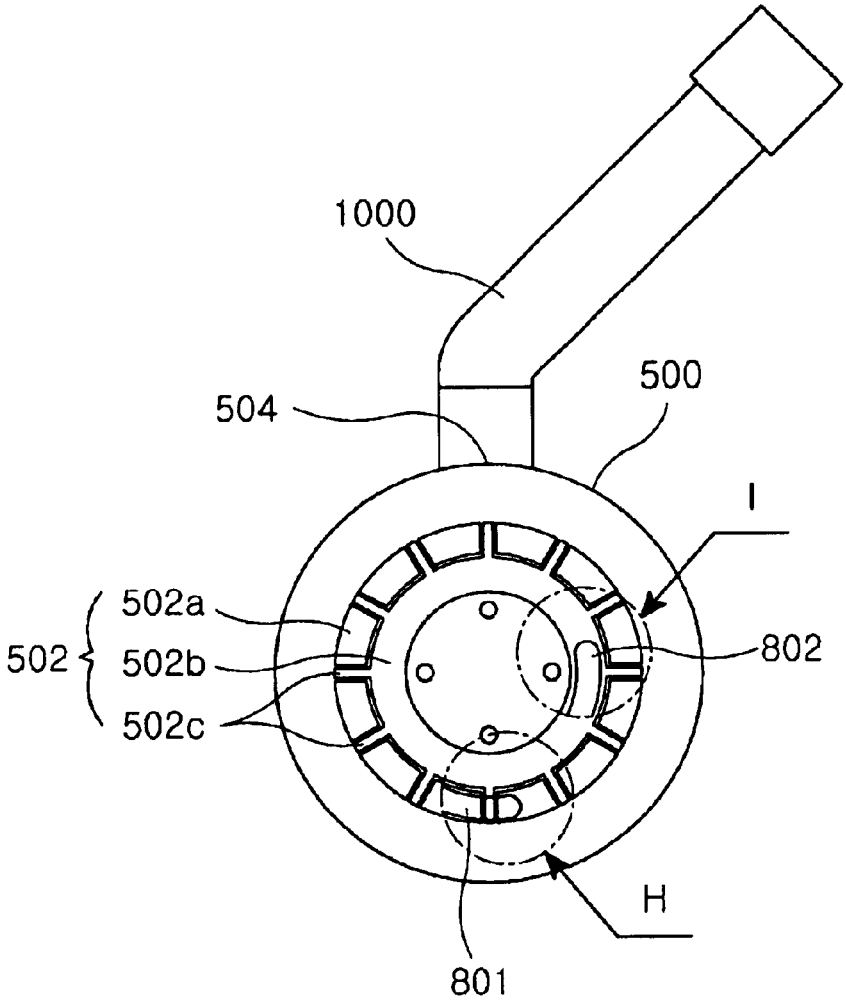
FIG. 26 is a plan view illustrating a second PCB included in the rotation key device in accordance with the second embodiment of the present invention.
Figure 27:
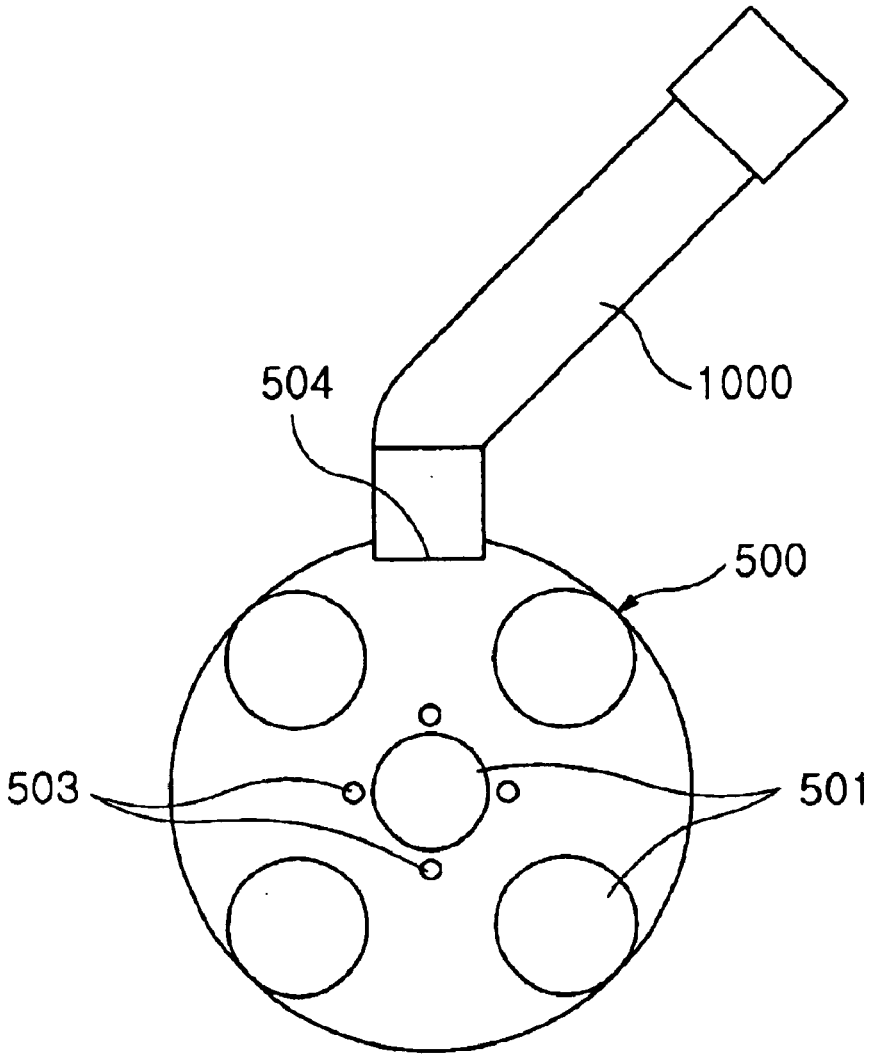
FIG. 27 is a bottom view illustrating the second PCB included in the rotation key device in accordance with the second embodiment of the present invention.
Figure 31:
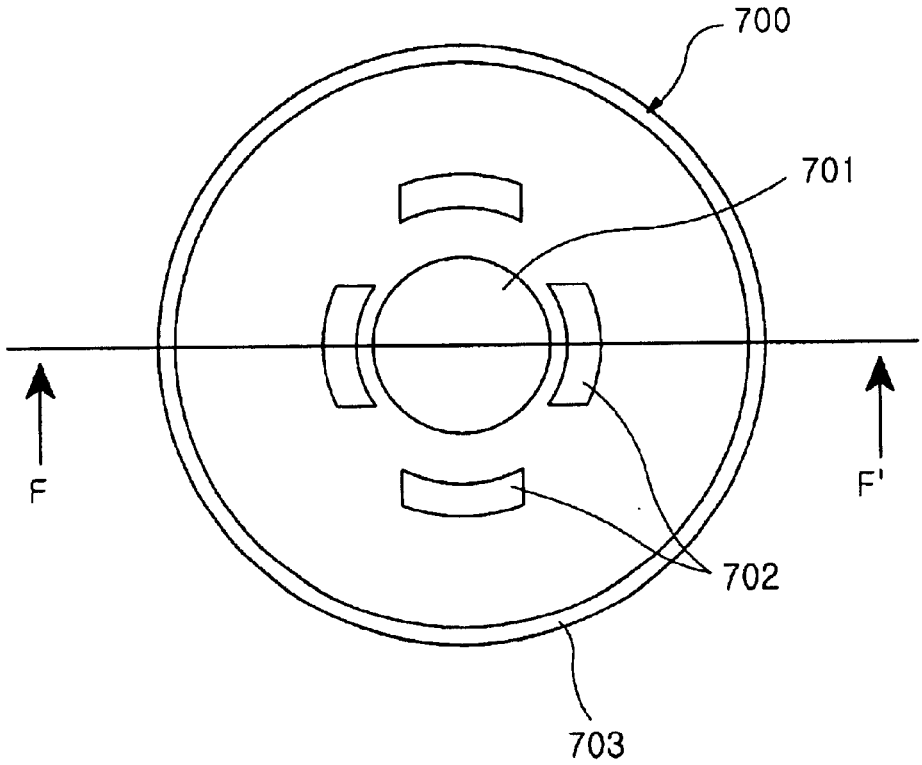
FIG. 31 is a plan view illustrating a rotation key in accordance with the second embodiment of the present invention.
Figure 32:
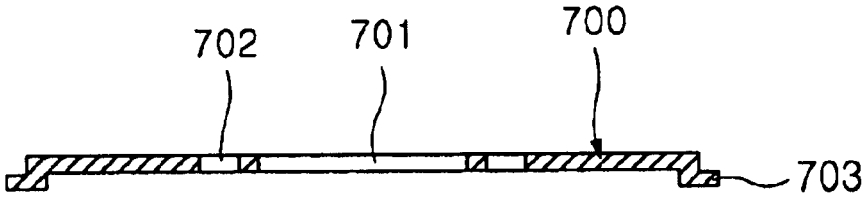
FIG. 32 is a sectional view corresponding to the line F–F' of FIG. 31.
Figure 33:
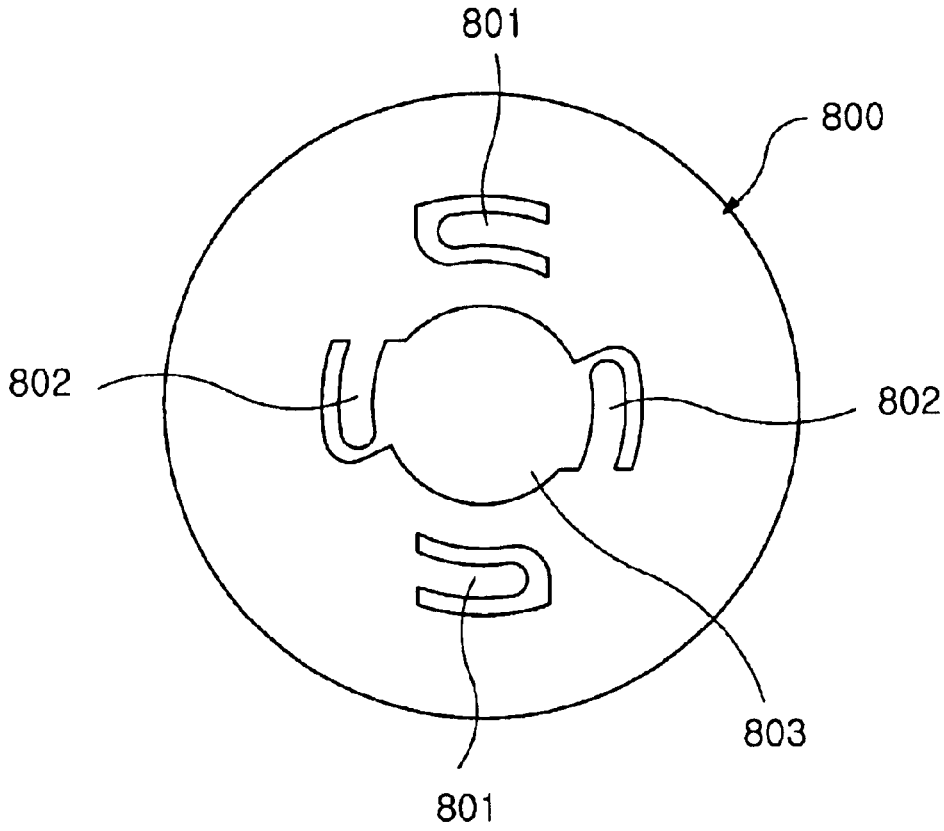
FIG. 33 is a plan view illustrating a contact plate included in the rotation key device in accordance with the second embodiment of the present invention.
Figure 34:
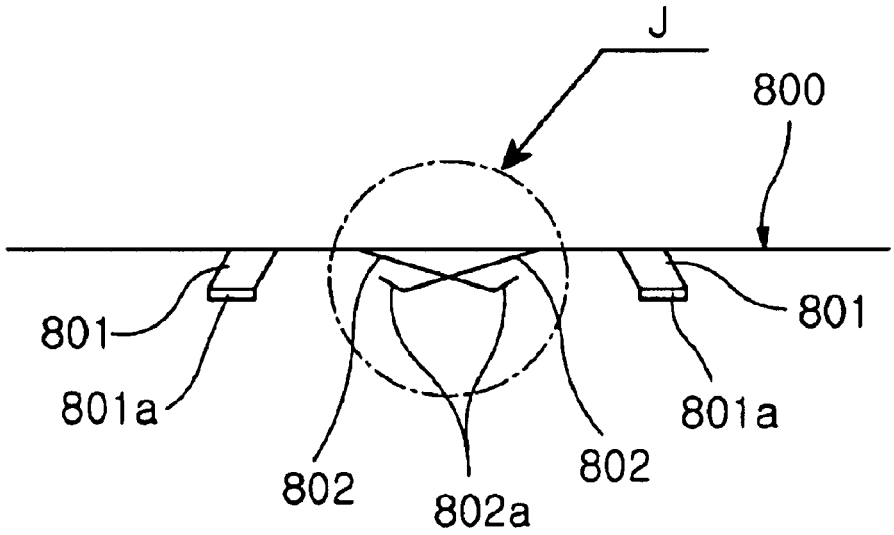
FIG. 34 is a side sectional view illustrating the contact plate included in the rotation key device in accordance with the second embodiment of the present invention.
Figure 35:
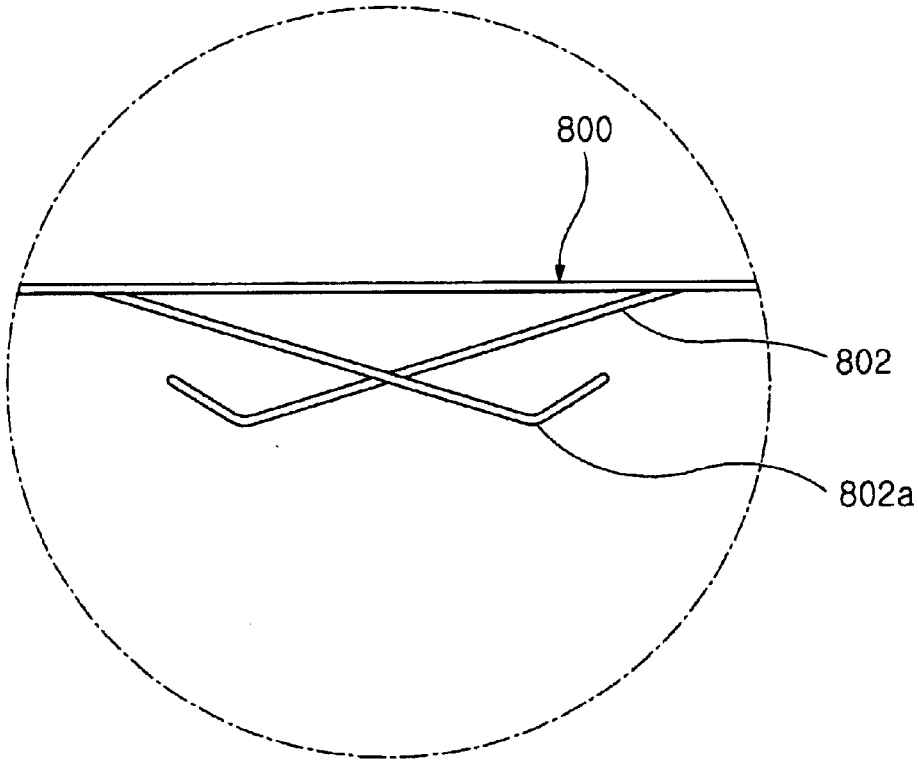
FIG. 35 is an enlarged sectional view of a portion "J" of FIG. 34.

As shown in FIGS. 20 and 21, the second PCB 500 and the ring-shaped washer 600 are coupled in this order to the base plate 400. A rotation key 700 is rotatably laid on the ring-shaped washer 600. As shown in FIG. 21, the rotation key 700 is provided with a circumferential step 703 extending along the circumference of the rotation key 700. The circumferential step 703 engages with arc-shaped grooves 403 circumferentially formed at the base plate 400. The rotation key 700 is rotatable on the ring-shaped washer 600 in forward and reverse directions by an external force applied thereto, as shown in FIGS. 31 and 32.

Figure 18:
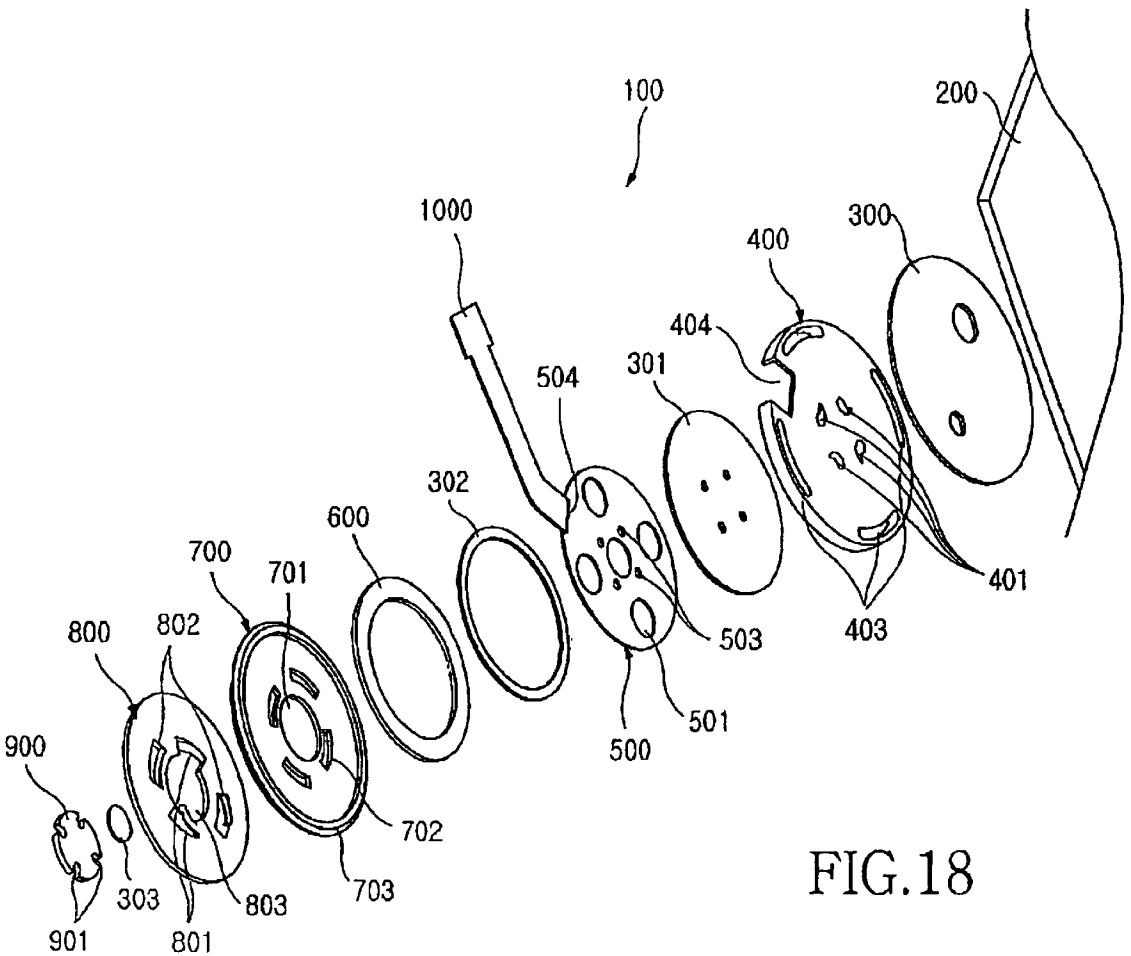
FIG. 18 is an exploded perspective view illustrating a rotation key device for a portable terminal in accordance with another embodiment of the present invention.
Figure 19:
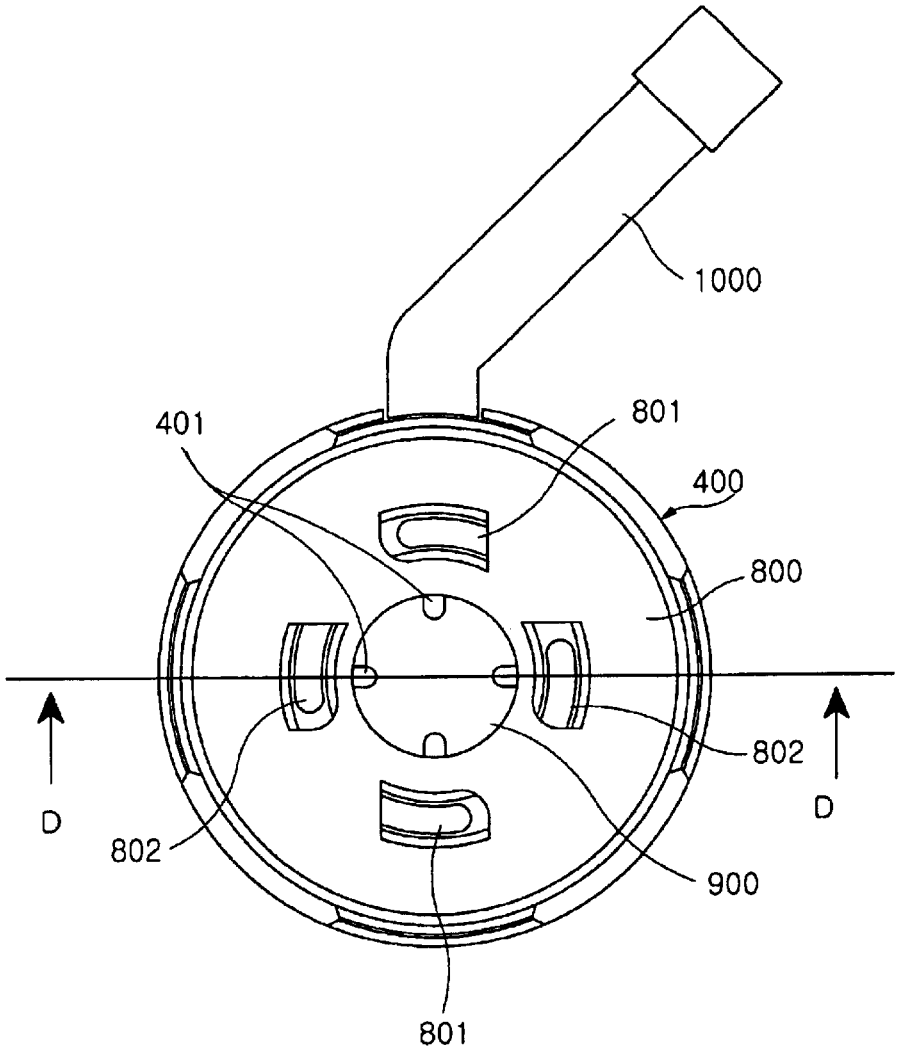
FIG. 19 is a plan view illustrating an assembled state of the rotation key device according to the second embodiment of the present invention.

As shown in FIGS. 18 through 22, a second through hole 701 is centrally formed in the rotation key 700 so that the rotation key 700 is attached to base plate 400 with the coupling protrusions 401 of the base plate 400 extending through the second through hole 701. In this state, a contact plate 800 is mounted on the upper surface of the rotation key 700, as shown in FIG. 18.

As shown in FIG. 18, the rotating key 700 is also provided with a plurality of third through holes 702. The third through holes 702 extend circumferentially while being substantially uniformly spaced apart from one another. The third through holes 702 are substantially symmetrically arranged such that they face each other. The third through hole 702 allow first and second contact terminals 801 of the contact plate 800 to extend therethrough and come into contact with first and second contact surfaces 502*a* and 502*b* of the second PCB 500 (See FIG. 26). Thus, as the contact plate 800 is coupled to the rotation key 700, the first and second contact terminals 801 and 802 are brought into contact with the first and second contact surfaces 502*a* and 502*b* through the third through holes 702. The first and second contact terminals 801 and 802 of the contact plate 800 are arranged to be substantially uniformly spaced apart from one another in a circumferential direction. Both the first and second contact terminal pairs 801 and 802 of the contact plate 800 are formed substantially symmetrically such the first contact pair 801 faces each other as does the second contact pair 802. Both the first and second contact terminal pairs 801 and 802 cross each other in the rotating direction of the rotation key 700.

Each of the contact terminals 801 and 802 has, at its free end, a bent portion 801*a* or 801*b* adapted to allow the contact terminals 801 and 802 to come into reliable contact with the contact surfaces 502.

A fixed button 900 is bonded to a central portion of the upper surface of the second PCB 500 by means of a fourth bonding member 303. A plurality of coupling grooves 901 are formed at the circumference of the fixed button 900. The coupling grooves 901 are engaged with the coupling protrusions 401 of the base plate 400, while the coupling protrusions 401 extend first through the second PCB 500, then through the washer 600, and finally the contact plate 800. If the contact plate 800 is rotated under this condition, the rotation key 700 is also rotated.

The contact surfaces 502 of the second PCB 500 comprise a plurality of first and second contact surfaces 502*a* and 502*b* formed at the upper surface of the second PCB 500 (see FIG. 26) such that they are circumferentially arranged while being substantially uniformly spaced apart from one another. They receive an electrical contact signal in a fixed state of the contact plate 800 or during the rotation of the contact plate 800, to thereby sense the rotation positions of the first and second contact terminals 801 and 802 according to the rotation directions of the first and second contact terminals 801 and 802.

Figure 28:
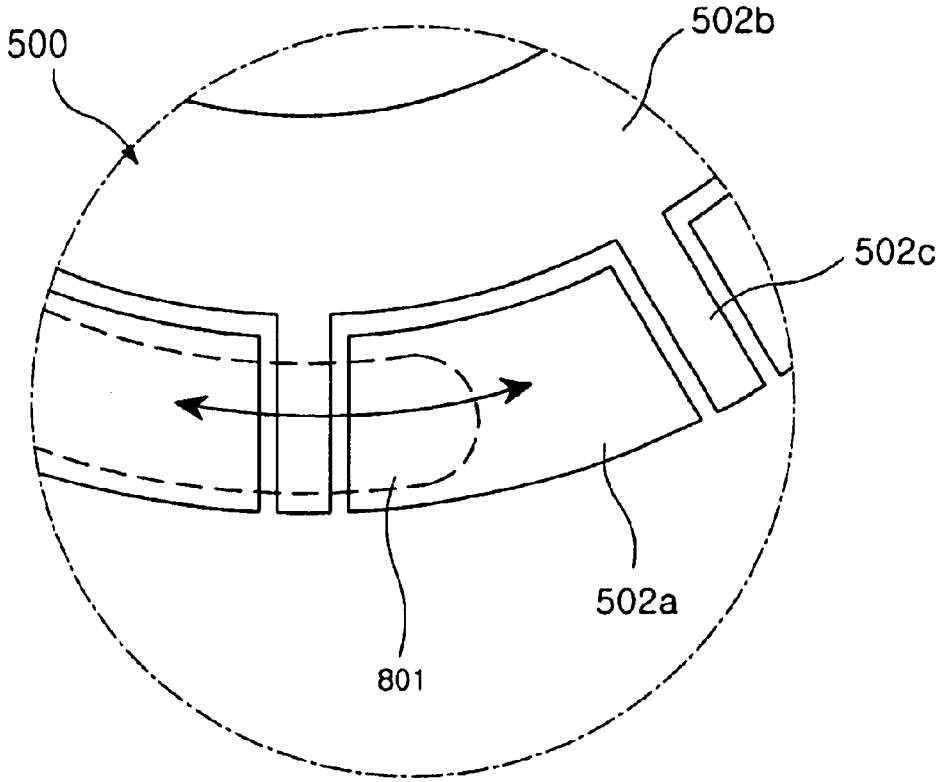
FIG. 28 is an enlarged sectional view corresponding to a portion "H" of FIG. 26, illustrating the state in which a first contact terminal enters between first contact surfaces.

As shown in FIG. 28, when the first contact terminal 801 come between the first contact surfaces 502*a* as the first contact terminal 801*s* rotate in a certain direction, electrical contact signals are generated at the inserted positions of the first contact terminals 801.

Figure 29:
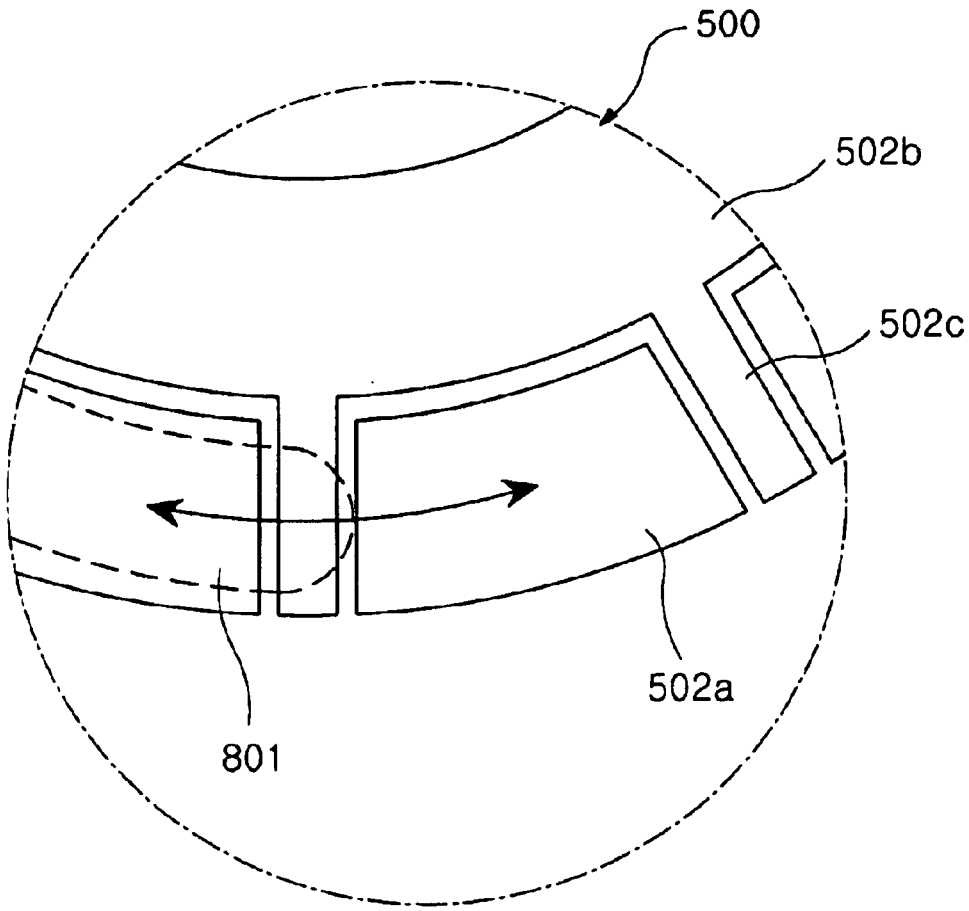
FIG. 29 is an enlarged sectional view corresponding to the portion "H" of FIG. 26, illustrating the state in which the first contact terminal enters between inserted contact surfaces.
Figure 30:
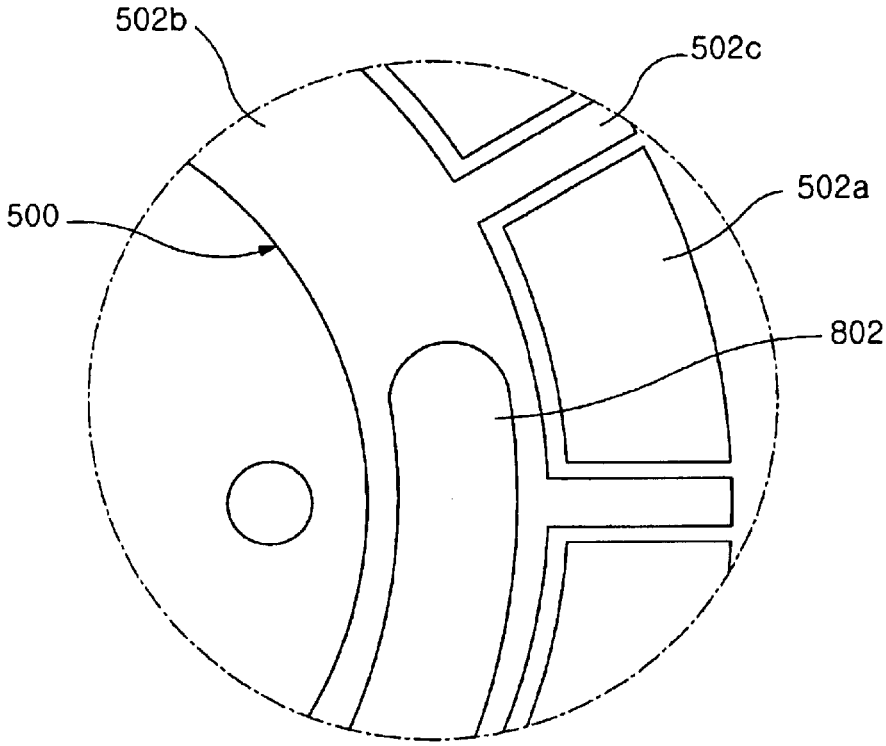
FIG. 30 is an enlarged sectional view corresponding to a portion "I" of FIG. 26, illustrating the state in which a second contact terminal contacts a second contact surface.

As shown in FIG. 29, the second contact surfaces 502*b* are defined inside the first contact surfaces 502*a*. A plurality of inserted contact surfaces 502*c* are provided along the circumference of the second contact surfaces 502*b* to allow the contact terminals 801 between the first contact surfaces 502*a*. When any of the first contact terminals 801 comes between adjacent ones of the inserted contact surfaces 502*c* between the first contact surfaces 502*a* along with the rotation of the first contact terminal 801 in a certain direction, an electrical contact signal is generated at the position of the first contact terminal 801. The second contact terminal pair 802 is in contact with the second contact surfaces 502*b*, while supporting the first contact terminals 801 rotatably.

A brief description will now be given of the sequence of electrical contact signals generated as the contact terminals 801 and 802 come into contact with the contact surfaces 502*a*, 502*b* and 502*c* in accordance with the rotation of the rotation key 700.

It is assumed that the contact signals of the rotation key 700 correspond to "A", "B", "C", "D", and "E". When the rotation key 700 rotates in a forward or clockwise (CW) direction, the contact signals from the contact terminals 801 and 802 are generated in a sequence of E-D-C-B-A-E . . . . Alternatively, when the rotation key 700 rotates in a reverse or counter-clockwise (CCW) direction, the contact signals from the contact terminal 801 are generated in a sequence of A-B-C-D-E-A . . . . The sequence of contact signals from the contact between the first contact terminals 801 and the contact surfaces 502 are sent to the body 10 of the portable terminal via a flexible PCB 1000 contacting a contact portion 504 of the second PCB 500. When a user selects a desired operation mode function while rotating the rotation key 700, and presses an associated button, an associated one of the dome switches 501 comes into contact with an associated contact of the second PCB 500. As a result, an electrical signal is applied to the second PCB 500, and then sent to the body 10 of the portable terminal via the flexible PCB 1000. The fixed button 900 performs one of a plurality of operation mode functions given to the portable terminal, e.g., a cancel key function. When the user presses the fixed button 900, the central dome switch 501 comes into contact with an associated contact of the second PCB 500. As a result, an electrical signal is applied to the second PCB 500, and then sent to the body 10 of the portable terminal via the flexible PCB 1000.

The first contact terminals 801 can be configured to quickly ascertain the rotation of the rotation key 700 by elongating the first contact surfaces 502*a*, and to minimize ascertainment of the rotation of the rotation key 700 by shortening the first contact surfaces 502*a*. Likewise, the first contact terminals 801 can be configured to quickly ascertain the rotation of the rotation key 700 by shortening the inserted contact surfaces 502*c*. The rotation recognizing speed of the first contact terminals 801 can be controlled by adjusting the lengths of the contact surfaces 502*a* and 502*c*.

By configuring the contact terminals 801 and 802 as described above, the user can freely set the speed of scrolling on the LCD 2*a*. Given five first contact surfaces 502*a* for the first contact terminals 801, one rotation of the rotation key 700 leads to 5-line scrolling on the LCD 2*a* at a time.

Figure 36:
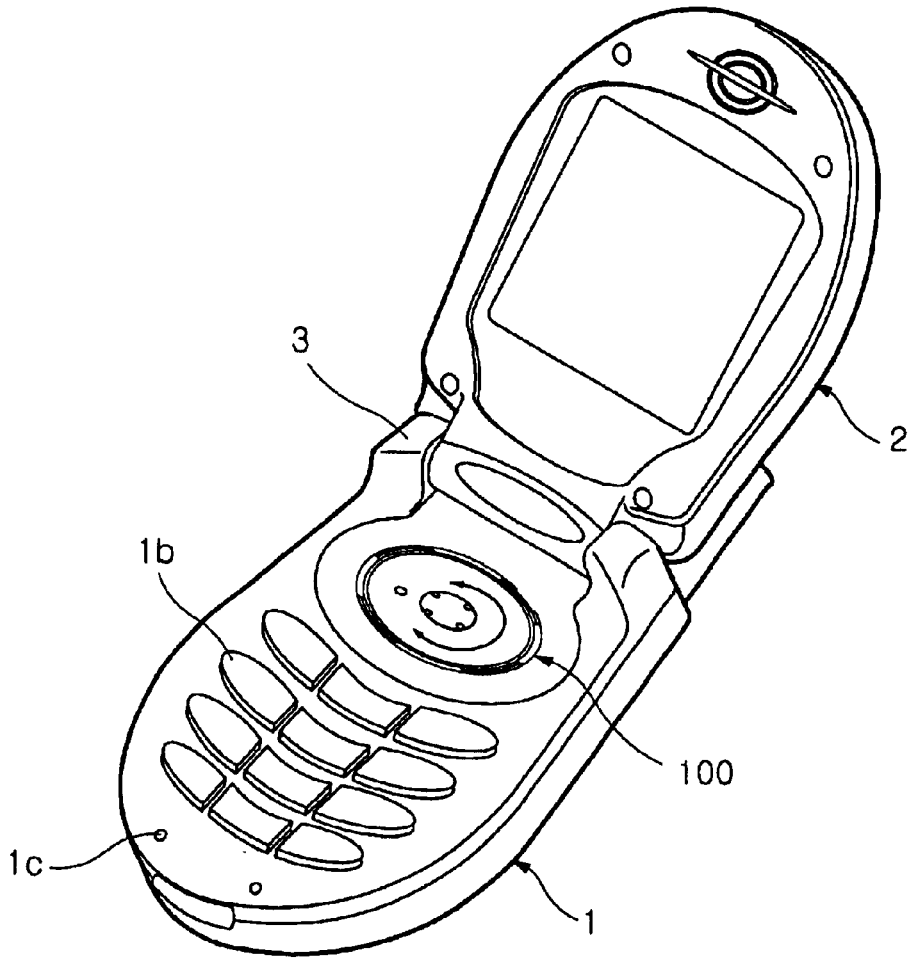
FIG. 36 is an perspective view illustrating the portable terminal, to which the rotation key device according to the second embodiment of the present invention is applied, in a state in which its folder is opened.

As shown in FIG. 36, since a rotation key 700 configured to rotate in forward (CW) and reverse (CCW) directions is provided at the body 10 of the portable terminal in accordance with the second embodiment of the present invention, it is possible to rapidly select a desired sequence of keys in association with a desired operating mode function in the portable terminal. It is also possible to rapidly and conveniently achieve the confirmation of the selected operating mode function.

While the invention has been shown and described with reference to certain preferred embodiments thereof, they are merely exemplary applications. For example, the present invention is not limited to a folder-type terminal. It is applicable to any of portable terminals. Therefore, it will be understood by those skilled in the art that various changes in form and details may be made therein without departing from the spirit and scope of the invention as defined by the appended claims.

What is claimed is:

1. In an apparatus for inputting data by use of keys in a portable terminal, a rotation key device comprising:

a base plate attached, at a lower surface thereof, to an upper surface of a first printed circuit board (PCB) mounted in a body of the portable terminal;

a second PCB attached, at a lower surface thereof, to the upper surface of the base plate, the second PCB being provided with a plurality of first dome switches and a second dome switch at the lower and upper surfaces thereof, and with a plurality of contact surfaces along the circumference of the second dome switch, for receiving an electrical contact signal in either a fixed or rotated state of a contact terminal and thus sensing the rotated position of the contact terminal according to the rotation direction thereof;

a ring-shaped washer attached to the upper surface of the second PCB;

a rotation key supported by an upper surface of the ring-shaped washer so that the rotation key is rotatable in forward and reverse directions by an external force applied thereto;

a contact plate provided in the rotation key to rotate along with the rotation key, the contact plate having a plurality of contact terminals each adapted to come into contact with one of the contact surfaces of the second PCB and to generate an electrical signal from a rotation contact and a fixed contact of the rotation key and apply the electrical contact signal to each of the contact surfaces coming into contact therewith; and a fixed button coupled centrally with the rotation key so that the rotation key is rotatable.

2. The rotation key device according to claim 1, wherein the base plate has a substantially circular disc structure substantially centrally provided with a pair of coupling holes, a through hole in the vicinity of the coupling holes to extend a flexible PCB therethrough, and an insertion hole to allow the second PCB to extend therethrough.

3. The rotation key device according to claim 1, wherein the first and second dome switches are provided with a plurality of support members to facilitate the operation of the dome switches in contact with the dome switches.

4. The rotation key device according to claim 1, further comprising:

a first bonding member between the first PCB and the base plate, for attaching the base plate to the first PCB;

a second bonding member between the second PCB and the ring-shaped washer, for attaching the ring-shaped washer to the second PCB; and first and second switching bonding members on the lower and upper surfaces of the second PCB, for attaching the first and second dome switches to the lower and upper surfaces of the second PCB.

5. The rotation key device according to claim 1, wherein each of the switching bonding members is centrally provided with a pair of coupling holes to allow a fixing member of the fixed button to extend therethrough.

6. The rotation key device according to claim 1, wherein the second PCB is further provided with:

a pair of coupling holes formed at a central portion of the second PCB;

a plurality of light emitting diodes (LEDs) arranged at predetermined positions along the circumference of the second PCB;

the flexible PCB at a predetermined position of the second PCB, for applying a contact signal of the second PCB to the body; and a contact portion arranged at a predetermined position on a circumference of the second PCB, to come into contact with the flexible PCB.

7. The rotation key device according to claim 1, wherein the contact surfaces comprise:

a plurality of first contact surfaces formed at the upper surface of the second PCB so that the first contact surfaces are circumferentially arranged to be substantially uniformly spaced apart from one another, each of the first contact surfaces receiving an electrical contact signal from one of the contact terminals coming between first contact surfaces along with rotation of the contact terminal; and a plurality of second contact surfaces inside the first contact surfaces, the second contact surfaces being provided with a plurality of inserted contact surfaces formed around the circumference of the second contact surfaces, each of the inserted contact surfaces receiving an electrical contact signal from one of the contact terminals coming between inserted contact surfaces along with rotation of the contact terminal.

8. The rotation key device according to claim 1, wherein each of the contact surfaces is elongated or shortened to control the sensing speed of the contact terminals along with the rotation of the rotation key.

9. The rotation key device according to claim 1, wherein the contact terminals of the contact plate comprise:

a pair of first contact terminals, each for generating an electrical contact signal when the first contact terminal comes into contact with one of the first contact surfaces and the inserted contact surfaces; and a pair of second contact terminals, each for supporting the first contact terminals, in contact with one of the second surfaces.

10. The rotation key device according to claim 9, wherein each of the plurality of contact terminals of the contact plate is formed by cutting out a desired portion of the contact plate to leave a portion corresponding to the contact terminal, and then bending the portion corresponding to the contact terminal to be protruded toward the rotation key, and each of the plurality of contact terminals has a plate shape so that the contact terminal comes into contact with one of the first and second contact surfaces of the second PCB.

11. The rotation key device according to claim 1, wherein each of the first and second contact terminals has, at a free end thereof, a bent potion adapted to allow the contact terminal to come into contact with one of the contact surface.

12. The rotation key device of claim 1, wherein the contact plate further has a through hole formed at a substantially central portion of the contact plate to allow the fixing member of the fixed button to extend therethrough.

13. The rotation key device according to claim 1, wherein the plurality of contact terminals are substantially symmetrically arranged to face each other, and the facing ones of the plurality of contact terminals cross each other.

14. The rotation key device according to claim 1, wherein the con tact plate is made of a stainless steel material.

15. The rotation key device according to claim 1, wherein the rotation key comprises:

an upper case and a lower case;

fitting holes, each formed at a center portion of the upper or lower case to allow the fixed button to fit thereinto;

a first step centrally formed in the upper case, to couple the rotation key to the fixed button so that the rotation key is rotatable;

a second step centrally formed in the lower case, to couple the rotation key to the fixing member of the fixed button so that the rotation key is rotatable; and a case bonding member between the upper and lower cases, for attaching the lower case to the upper case.

16. The rotation key device of claim 1, wherein t he fixed button further comprises:

a fixing member under the fixed button, for extending through the second PCB, the ring-shaped washer and the contact plate sequentially, coupling one another;

a pair of coupling protrusions formed at the fixed member, for extending through the through hole of the contact plate, the coupling holes of the second PCB, the coupling holes of the base plate, and the coupling holes of the switch bonding members, coupling one to another; and a through hole formed at a center portion of the fixed member, for allowing a supporting portion at the rear surface of the fixed button to extend therethrough and come into contact with the second dome switch.

17. The rotation key device of claim 16, wherein each of the coupling protrusions has, at the tip thereof, a bending portion to be coupled to the rear surface of the base plate.

18. In an apparatus for inputting data by use of keys in a portable terminal, a rotation key device comprising:

a base plate attached, at a lower surface thereof, to an upper surface of a first printed circuit board (PCB) mounted in a body of the portable terminal, the base plate being substantially centrally provided at an upper surface thereof with a plurality of coupling protrusions;

a second PCB attached, at a lower surface thereof, to the upper surface of the base plate while allowing the coupling protrusions to extend therethrough, the second PCB being provided at the lower surface thereof with a plurality of dome switches, and at an upper surface thereof with a plurality of contact surfaces for receiving an electrical contact signal at either a rotated position or a fixed position of a contact terminal and sensing the rotated position of the contact terminal according to the rotation direction of the contact terminal;

a ring-shaped washer attached to the upper surface of the second PCB;

a rotation key supported by an upper surface of the ring-shaped washer so that the rotation key is rotatable in forward and reverse directions by an external force applied thereto;

a contact plate coupled to an upper surface of the rotation key to rotate along with the rotation key, the contact plate having a plurality of contact terminals each adapted to come into contact with one of the contact surfaces of the second PCB and to generate an electrical contact signal at a rotation contact or a fixed contact of the rotation key; and a fixed button coupled with a center portion of the upper surface of the second PCB.

19. The rotation key device according to claim 18, further comprising:

a first bonding member between the first PCB and the base plate, for attaching the base plate to the first PCB;

a second bonding member between the second PCB and the base plate, for attaching the second PCB to the base plate;

a third bonding member between the second PCB and the ring-shaped washer, for attaching the ring-shaped washer to the second PCB; and a fourth bonding member between the second PCB and the fixed button, for attaching the fixed button to the second PCB.

20. The rotation key device of claim 18, wherein the base plate has a substantially circular disc structure substantially centrally provided with the coupling protrusions.

21. The rotation key device according to claim 18, wherein each of the plurality of coupling protrusions of the base plate has, at a free end thereof, a jaw extending substantially horizontally toward a center of the base plate, the jaw being forcibly extended through an associated one of first through holes formed at the second PCB, and then engaged with the second PCB around the associated through hole.

22. The rotation key device according to claim 21, wherein the jaws are substantially symmetrically arranged to face each other, and the arc-shaped grooves are substantially symmetrically arranged to face each other.

23. The rotation key device according to claim 18, wherein the base plate is further provided with:

a plurality of substantially uniformly spaced arc-shaped grooves formed along a circumference of the base plate so that the grooves are engagable with a circumferential step formed at the rotation key, thereby allowing the rotation key to be rotatable on the base plate without being separated from the base plate;

a guide groove formed at a desired position on the circumference of the base plate, and adapted to guide a flexible PCB contacting the second PCB; and a plurality of support portions formed at the base plate, respectively adapted to support the dome switches in a stale in which the base plate is coupled with the dome switches.

24. The rotation key device according to claim 18, wherein the second PCB is further provided with:

a plurality of through holes arranged at a central portion of the second PCB, and adapted to allow the coupling protrusions to extend therethrough; and a contact portion arranged at a desired position on a circumference of the second PCB, and adapted to come into contact with the flexible PCB.

25. The rotation key device according to claim 18, wherein the contact surfaces comprise:

a plurality of first contact surfaces formed at the upper surface of the second PCB so that the first contact surfaces are circumferentially arranged to be substantially uniformly spaced apart from one another, each of the first contact surfaces receiving an electrical contact signal from one of the contact terminals coming between first contact surfaces along with rotation of the contact terminal; and a plurality of second contact surfaces inside the first contact surfaces, the second contact surfaces being provided with a plurality of inserted contact surfaces formed around the circumference of the second contact surfaces, each of the inserted contact surfaces receiving an electrical contact signal from one of the contact terminals coming between inserted contact surfaces along with rotation of the contact terminal.

26. The rotation key device according to claim 25, wherein each of the contact surfaces is elongated or shortened to control the sensing speed of the contact terminals along with the rotation of the rotation key.

27. The rotation key device according to claim 18, wherein the contact terminals of the contact plate comprise:

a pair of first contact terminals, each for generating an electrical contact signal when the first contact terminal comes into contact with one of the first contact surfaces and the inserted contact surfaces; and a pair of second contact terminals, each for supporting the first contact terminals, in contact with one of the second surfaces.

28. The rotation key device according to claim 27, wherein each of the plurality of first and second contact terminals of the contact plate is formed by cutting out a desired portion of the contact plate to leave a portion corresponding to the contact terminal, and then bending the portion corresponding to the contact terminal to be protruded toward the rotation key, and each of the plurality of contact terminals has a plate shape so that the contact terminal comes into contact with one of the first and second contact surfaces of the second PCB through the third through hole.

29. The rotation key device according to claim 27, wherein the plurality of first and second contact terminals are substantially symmetrically arranged to face each other, and the facing ones of the plurality of contact terminals cross each other in a rotating direction of the rotation key.

30. The rotation key device according to claim 27, wherein each of the contact terminals has, at a free end thereof, a bent portion adapted to allow the contact terminal to come into contact with one of the contact surfaces.

31. The rotation key device according to claim 18, wherein the contact plate further has a fourth through hole formed at a substantially central portion of the contact plate to allow the coupling protrusions to extend therethrough.

32. The rotation key device according to claim 18, wherein the contact plate is made of a stainless steel material.

33. The rotation key device according to claim 18, wherein the rotation key is provided with:

a second through hole formed at a central portion of the rotation key to allow the coupling protrusions to extend therethrough;

a plurality of third through holes formed around the second through hole while extending circumferentially to be substantially uniformly spaced apart from one another, each of the third through holes allowing an associated one of the contact terminals to extend therethrough; and a circumferential step extending along a circumference of the rotation key, the circumferential step engaging with the arc-shaped grooves circumferentially formed at the base plate.

34. The rotation key device according to claim 33, wherein the third through holes are symmetrically arranged to face each other.

35. The rotation key device according to claim 18, wherein the fixed button is provided at a circumference thereof with a plurality of coupling grooves respectively engagable with the coupling protrusions of the base plate, in a state where the coupling protrusions sequentially extend through the second PCB, the ring-shaped washer, the rotation key and the contact plate.

* * * * *